US011873157B2

(12) United States Patent
Upchurch et al.

(10) Patent No.: US 11,873,157 B2
(45) Date of Patent: Jan. 16, 2024

(54) ACTUATOR FOR AEROSOL CONTAINER

(71) Applicants: Paula Upchurch, Houston, TX (US); Mark Upchurch, Houston, TX (US)

(72) Inventors: Paula Upchurch, Houston, TX (US); Mark Upchurch, Houston, TX (US)

( * ) Notice: Subject to any disclaimer, the term of this patent is extended or adjusted under 35 U.S.C. 154(b) by 0 days.

(21) Appl. No.: 17/233,094

(22) Filed: Apr. 16, 2021

(65) Prior Publication Data

US 2021/0323754 A1 Oct. 21, 2021

Related U.S. Application Data

(60) Provisional application No. 63/010,993, filed on Apr. 16, 2020.

(51) Int. Cl.
*B65D 83/20* (2006.01)
*B65D 83/38* (2006.01)

(52) U.S. Cl.
CPC ..... *B65D 83/205* (2013.01); *B65D 83/38* (2013.01)

(58) Field of Classification Search
CPC ..... B65D 83/205; B65D 83/38
USPC ..... 222/402.13, 153.1, 402.1
See application file for complete search history.

(56) References Cited

U.S. PATENT DOCUMENTS 2,733,842 A 2/1956 Abplanalp
3,134,518 A 5/1964 Sagarin et al.
3,227,321 A * 1/1966 Sagarin ..... B65D 83/205 222/402.13
3,278,093 A 10/1966 Lehmann
3,519,173 A * 7/1970 Sagarin ..... B65D 83/24 222/402.13
3,540,624 A * 11/1970 Green ..... B65D 83/228 222/108
3,669,321 A 6/1972 Susuki et al.
3,991,916 A 11/1976 Del Bon
7,854,356 B2 12/2010 Eberhardt
8,403,184 B2 3/2013 Eberhardt et al.
8,967,435 B2 3/2015 Nyambi et al.
9,981,799 B2 * 5/2018 Andersen ..... B65D 83/205
2007/0164056 A1 7/2007 Eberhardt et al.
(Continued)

FOREIGN PATENT DOCUMENTS

EP 0669268 B1 8/1995
JP 08143074 A 6/1996
(Continued)

*Primary Examiner* — Lien M Ngo
(74) *Attorney, Agent, or Firm* — FOLEY & LARDNER LLP

(57) ABSTRACT

An aerosol actuator, delivery system, and a method. The actuator includes a plunger and a housing for engagement with an activation valve for controlling delivery of an aerosol from an aerosol container. A channel extends through the plunger from a front to a bottom side. The channel defines a ventral opening along a front side and a dorsal opening along a bottom side. The dorsal opening is configured to receive and be supported by a stem of an activation valve of an aerosol container against the top side wall of an upper sidewall of the housing. A partial opening of a bore along a top side of the upper sidewall and a sliced opening formed along a back side allows the plunger to fit through to the inside of the upper sidewall. A releasable holding mechanism extends along a bore in a lower sidewall of the housing.

19 Claims, 33 Drawing Sheets

(56) References Cited

U.S. PATENT DOCUMENTS

| | | | | |
|---|---|---|---|---|
| 2010/0044401 | A1 | 2/2010 | Eberhardt et al. | |
| 2017/0233171 | A1* | 8/2017 | Christianson ..... | B65D 83/207<br>222/402.13 |

FOREIGN PATENT DOCUMENTS

| | | | |
|---|---|---|---|
| WO | 0196210 | A2 | 12/2001 |
| WO | 2015125654 | A1 | 8/2015 |

* cited by examiner

ACTUATOR FOR AEROSOL CONTAINER

RELATED APPLICATIONS

The present disclosure claims the benefit of and priority to U.S. Prov. Appl. 63/010,993, filed Apr. 16, 2020, which is incorporated herein by reference in its entirety.

TECHNICAL FIELD

The present disclosure relates to containers for discharging an aerosol product contained therein and more particular to a device, a system, and a method for discharging an aerosol product from a container.

BACKGROUND

Aerosol spray containers have been used as convenient packages for an ever increasing range of products including hair spray, paints, insecticides, and shaving cream.

As shown in prior art FIG. 1A, an aerosol delivery system 5 comprises an aerosol container 10 in combination with an activation device 20, a propellent 12, a liquid product 14, and a dip tube 16. The aerosol container 10 is typically made from a metal like steel with a thin coating of tin. The liquid product 14 is the liquid product to be released from the aerosol container 10. The product may be a hair spray, a paint, an insecticides, a shaving cream, and so on. The propellant 12 is a pressurized gas that helps to push the liquid product into the air as an aerosol spray 50 (see prior art FIG. 2B). The propellant 12 typically turns in part into a liquid when it is forced inside the aerosol container 10 at a high pressure during manufacturing. This allows for the liquid product 14 and the propellant 12 to mix together easily on shaking of the aerosol can 10.

The activation device 20 is a device that releases the mixed liquid product 14 and propellant 12 from the aerosol container 10. Prior art FIG. 1B shows the activation device 20 in greater detail comprising an actuator 22 and an activation valve 21 which comprises a valve stem 23, a gasket 24, a valve mounting cup 26, a spring 28, and a valve body 29. The actuator 22 is a button which enables a user to activate the aerosol delivery system. The actuator is configured with a channel and a valve opening 25 where the product comes out. The valve stem 23 is the connection between the actuator and spring 28. The gasket 24 is a gasket that seals the opening around the valve stem 23, keeping the container airtight. The spring 28 maintains pressure on the gasket which seals the container. The valve mounting cup 26 connects the activation device to the aerosol container. The valve body 29 opens and closes the aerosol container 10.

The aerosol container 10 is filled with the product to be sprayed and the propellant which may be a compressed gas such as butane or Freon. Typically, the gas is partly liquefied by the pressure in the container, with a layer of free gas above the liquid. Shaking of the aerosol container mixes the liquid product and the propellent.

The dip tube 16 is a hollow tube which extends from the activation device to the bottom of the container, allowing the product under pressure to be pushed out through the activation valve when the actuation valve is activated by the actuator.

Shaking of the aerosol container 10 mixes the liquid product and the propellent.

FIG. 2 depicts the operation of the prior art activation device. FIG. 2A is the prior art activation device shown in FIG. 1B depicted in a relaxed state where no aerosol is released from the aerosol container. FIG. 2B is the prior art activation device shown in FIG. 1B depicted in an activated state where aerosol is sprayed from the aerosol container. The numbered elements show in FIG. 2 have the same function and operate in the same way as like numbered elements in FIG. 1.

As shown in FIG. 2B, when the actuator 22 is depressed, it pushes the valve stem 23 down against the spring 28, relieving the pressure that keeps the gasket 24 sealed. When the seal opens, the higher pressure inside the can pushes the product up through the dip tube and out of the valve device 20 (i.e., actuation device 20). A controlled amount of propellant in the product vaporizes as it leaves the can, creating a spray or foam. A small amount of liquefied propellent still in the aerosol can vaporizes, keeping the pressure constant. The combination of liquid product and propellant is finely tuned to produce the right concentration, spray pattern and particle size to make the product most effective.

The activation device provided with an aerosol container is typically an integral component of the aerosol container. The aerosol container and activation device provide an integrated aerosol delivery solution. However, product remaining in the actuator component of an activation device after use may dry up and clog the channel and orifice of the actuator component which may negatively affect the performance of the aerosol delivery solution in future applications. For this reason, the actuator component is often configured to be removable from the activation device. The actuator once removed may be readily cleaned such as by placement into a container with a solvent. After cleaning, the actuator may be placed back onto the valve stem of the activation device to allow the aerosol delivery solution to be further used.

A big problem with conventional aerosol delivery solutions is the loss or misplacement of an actuator. When an actuator is lost or misplaced, the aerosol delivery solution may no longer be useable since the activation device is missing the actuator component used to activate the activation device and release aerosol from the aerosol container. If the aerosol delivery system is no longer useable, the aerosol container may be discarded. This may result in product remaining in the aerosol container going to waste. It may also increase the number of aerosol containers populating the ecosystem since if an aerosol container is discarded, it is usually replaced.

Even if the actuator is not lost or misplaced, the actuator tends to be a small component. This may make cleaning of the component harder. Its small size may also makes the component harder to replace on the valve stem of the activation device.

There is a need for an actuator that is so configured as to be less likely to be lost or misplaced and is easier to handle and service. These aspects may contribute to a longer life for aerosol containers, more product used from containers, fewer aerosol containers populating the ecosystem since with longer use of aerosol containers fewer replacement containers would be needed, and an actuator that is of a size and shape that may be easier to remove, clean, and replace. This disclosure addresses these needs.

SUMMARY

In one aspect, disclosed is an actuator for engagement with an activation device for controlling delivery of an aerosol from an aerosol container. The actuator may include a plunger and a housing.

The plunger may include a front side including a curved front surface and a protruding member, opposing sides including opposing surfaces, a back surface including a back surface, a top side including a downwardly tapered top surface, and a bottom surface. A channel extends through the plunger from a front side of the plunger through the protruding member to the bottom side of the plunger. The channel defines a ventral opening extending along the front side of the plunger and a dorsal opening extending along the bottom side of the plunger.

The housing may be configured for attachment to an aerosol container. The housing may include an upper sidewall and a lower sidewall. The upper sidewall extends along a top portion of the housing. A bore extends through the upper sidewall from the top to the bottom side of the upper sidewall along an inside surface of the upper sidewall. A top side wall extends along the top side of the upper sidewall from a front side of the upper sidewall to partially cover and form a partial opening of the bore along the top side of the upper sidewall. A stop ledge extends along a bottom side of the upper sidewall. A ventral opening extends along a front side of the upper sidewall, and a sliced opening formed along a back side of the upper sidewall.

The lower sidewall extends along a bottom portion of the housing. The lower sidewall may taper inwardly along a top side of the outer sidewall where the lower sidewall joins the upper sidewall. The lower sidewall defines a bore extending from the top to the bottom side of the lower sidewall. A releasable holding mechanism extends along the bore. The bore opens along the top side of the lower sidewall into the opening of the bore of the upper sidewall. The bore is configured for receiving an aerosol container. The releasable holding mechanism is configured to securely hold the housing to an aerosol container during delivery of aerosol from an aerosol container and to release an aerosol container after delivery of aerosol from an aerosol container.

The partial opening of the bore along the top side of the upper sidewall and the sliced opening formed along a back side of the upper sidewall allows the plunger to fit through to the inside of the upper sidewall.

The ventral opening of the upper sidewall allows the protruding member of the plunger to extend therethrough.

The inside surface of the bottom opening of the plunger is configured to receive and be supported by a stem of an actuation valve of an aerosol container against the top side wall of the upper housing.

On application of a force against the actuator, the actuator is configured to push a stem of the activation valve down to release aerosol from an aerosol can through the dorsal opening, the channel and the ventral opening of the plunger. The downward movement of the actuator under the influence of the applied force is stopped by the step ledge of the upper housing. On relaxation of a force applied to the actuator, the actuator is configured to cause the stem of the activation valve to return to its normal position to stop release of aerosol from an aerosol container.

In another aspect, disclosed is an aerosol delivery system, the aerosol delivery includes the disclosed actuator in combination with an activation valve in combination with an aerosol container.

The method for delivering an aerosol from an aerosol container using the disclosed actuator of this disclosure includes (1) taking an actuator configured for engagement with an activation valve for controlling delivery of an aerosol from an aerosol container; (2) placing the plunger of the actuator through the partial opening of the bore along the top side of the upper sidewall and the sliced opening formed along a back side of the upper sidewall to allow the plunger to fit through to the inside of the upper sidewall to the inside of the upper sidewall; (3) placing the inside surface of the bottom opening of the plunger of the actuator onto a stem of an activation valve of an aerosol container to support the plunger against the top side wall of the upper housing; and (4) applying force to cause the downward movement of the actuator.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

FIGS. 1A and 1B collectively form FIG. 1.

FIGS. 2A and 2B collectively form FIG. 2.

DETAILED DESCRIPTION

Figure 1B:
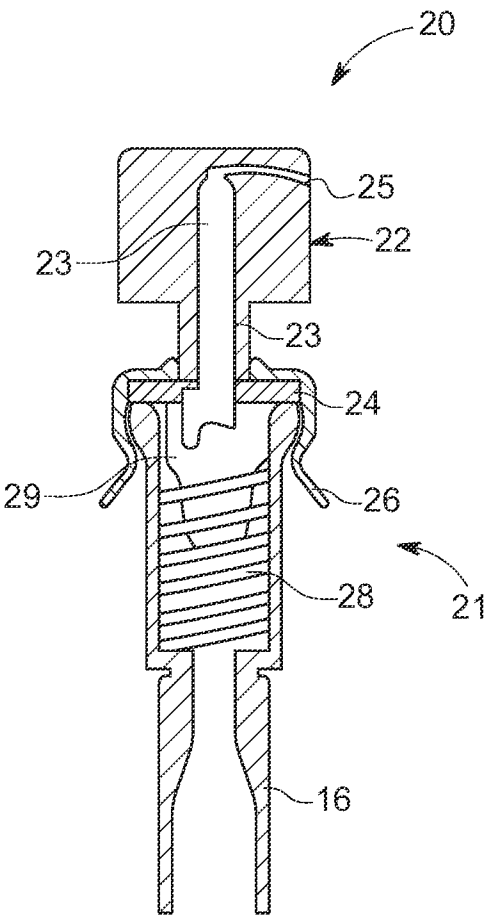
FIG. 1B Prior Art

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

Broadly speaking, disclosed is an aerosol actuator, the combination of the aerosol actuator with an activation valve for an aerosol container in a delivery system, and a method for delivering aerosol using the aerosol actuator of this disclosure. The disclosed actuator includes a plunger and a housing and is configured for engagement with an actuation valve for controlling delivery of an aerosol from an aerosol container. A channel extends through the plunger from a front side of the plunger to a bottom side of the plunger. The channel defines a ventral opening extending along a front side of the plunger and a dorsal opening extending along a bottom side of the plunger. The inside surface of the dorsal opening of the plunger is configured to receive and be supported by a stem of an actuation valve of an aerosol container against the top side wall of the upper housing. The housing includes an upper sidewall and a lower sidewall. A partial opening of a bore along a top side of the upper sidewall and a sliced opening formed along a back side of the upper sidewall allows the plunger to fit through to the inside of the upper sidewall. The lower sidewall defines a bore extending from a top to a bottom side of the lower sidewall. A releasable holding mechanism extends along the bore which opens along the top side of the lower sidewall into the opening of the bore of the upper sidewall. The bore is configured for receiving an aerosol container and the releasable holding mechanism is configured to securely hold the housing to an aerosol container during delivery of aerosol from an aerosol container and to release an aerosol container after delivery of aerosol from an aerosol container.

Figure 1A:
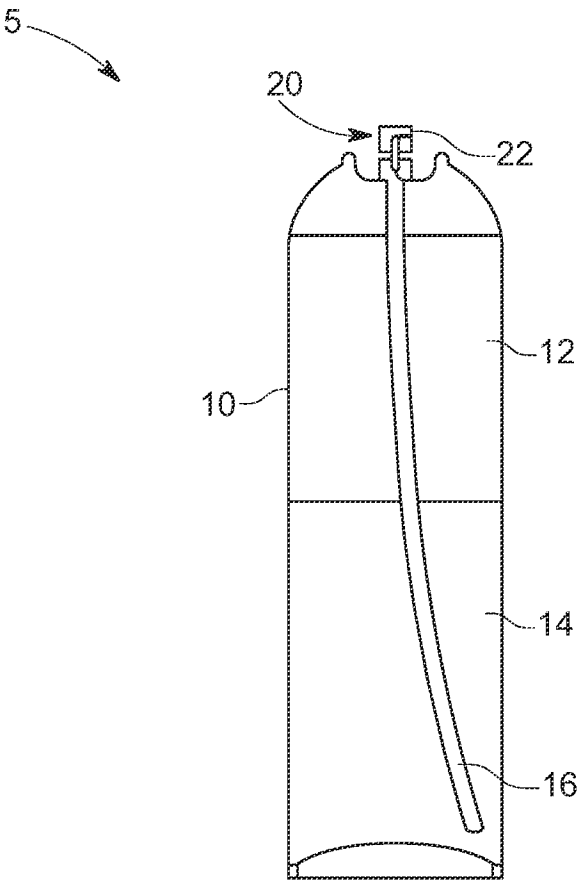
FIG. 1A Prior Art
FIG. 1A depicts a prior art aerosol delivery system and FIG. 1B a prior art activation device for use with the FIG. 1A aerosol delivery system.

As used herein the term "activation device" means the activation device 20 of the kind illustratively depicted in FIGS. 1A and 1B.

Figure 2B:
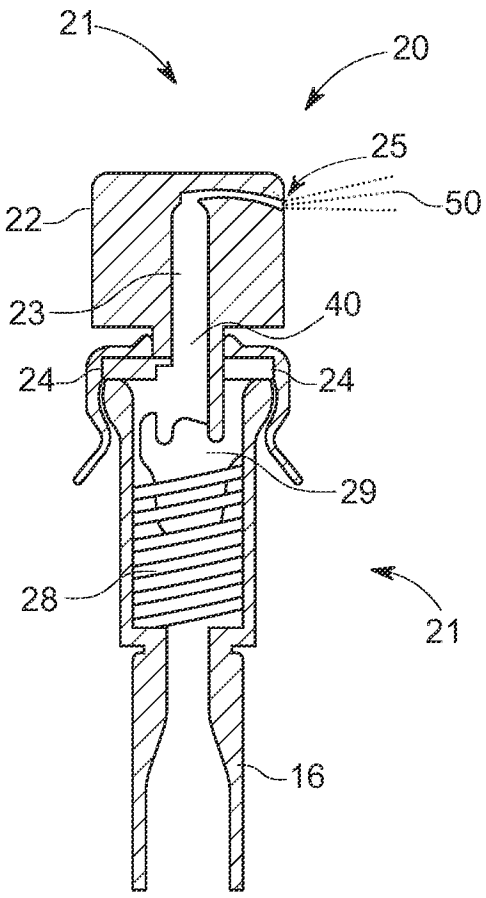
FIG. 2B Prior art
FIG. 2B is the activation device shown in FIG. 1B depicted in an activated state.
Figure 2A:
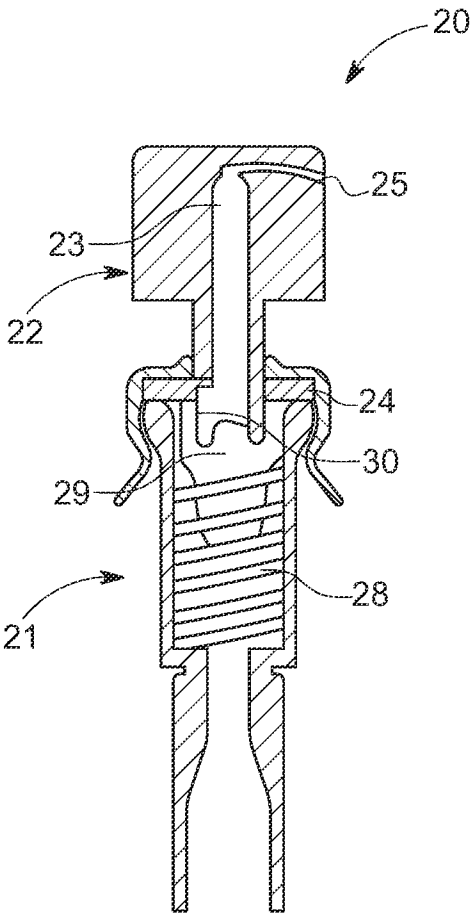
FIG. 2A Prior art
FIG. 2A is the activation device shown in FIG. 1B depicted in a relaxed state.

As used herein the term "actuator" means the actuator 110 of this disclosure as described in detail below which is designed and configured to replace the actuator 22 depicted in the prior art described in connection with FIGS. 1 and 2 that typically comes with the activation device. Replacement of the prior art actuator 22 of the kind depicted in illustrated in FIGS. 1 and 2 with the actuator 110 of this disclosure may occur when the prior art actuator 22 of the kind depicted in FIGS. 1 and 2 is misplaced, lost, or abandoned in favor of using the actuator 110 of this disclosure.

FIG. 1B shows the activation device 20 of the prior art in greater detail comprising an actuator 22 and an activation valve 21 of the prior art. As previously explained, the term "actuator" means not only the actuator 22 of the prior art but also the actuator 110 of this disclosure as described in detail below which is designed and configured to replace the actuator 22 of the prior art described in connection with FIGS. 1 and 2 that typically comes with the activation device. Hence, with the replacement of the actuator 22 of the prior art shown in FIGS. 1B and 2 with the actuator of this disclosure, FIGS. 1 and 2 with that replacement also shows the activation device 110 of this disclosure. Replacement of the prior art actuator 22 of the kind depicted in illustrated in FIGS. 1 and 2 with the actuator 110 of this disclosure may occur when the prior art actuator 22 of the kind depicted in FIGS. 1 and 2 is misplaced, lost, or abandoned in favor of using the actuator 2 of this disclosure.

The actuator 110 of this disclosure is illustratively depicted in FIGS. 3-32. To be clear, the actuator 110 of this disclosure is for replacement of the actuator 21 of the prior art that comes with an aerosol container. The actuator 110 of this disclosure is for use with the activation valve 21 of the prior art depicted in FIGS. 1 and 2 which comprises a valve stem 23, a gasket 24, a valve mounting cup 26, a spring 28, and a valve body 29. That combination of actuator 110 with activation valve 21 forms the activation device 20 depicted in FIGS. 1 and 2 except with the prior art actuator 21 being replaced with the actuator 110 of this disclosure.

FIGS. 3 through 11 depict an actuator 105 of this disclosure for engagement with an activation valve 25 (see FIGS. 1B, 2, 31, 32) for controlling delivery of an aerosol from an aerosol container 3010 (See 30-32).

Figure 3:
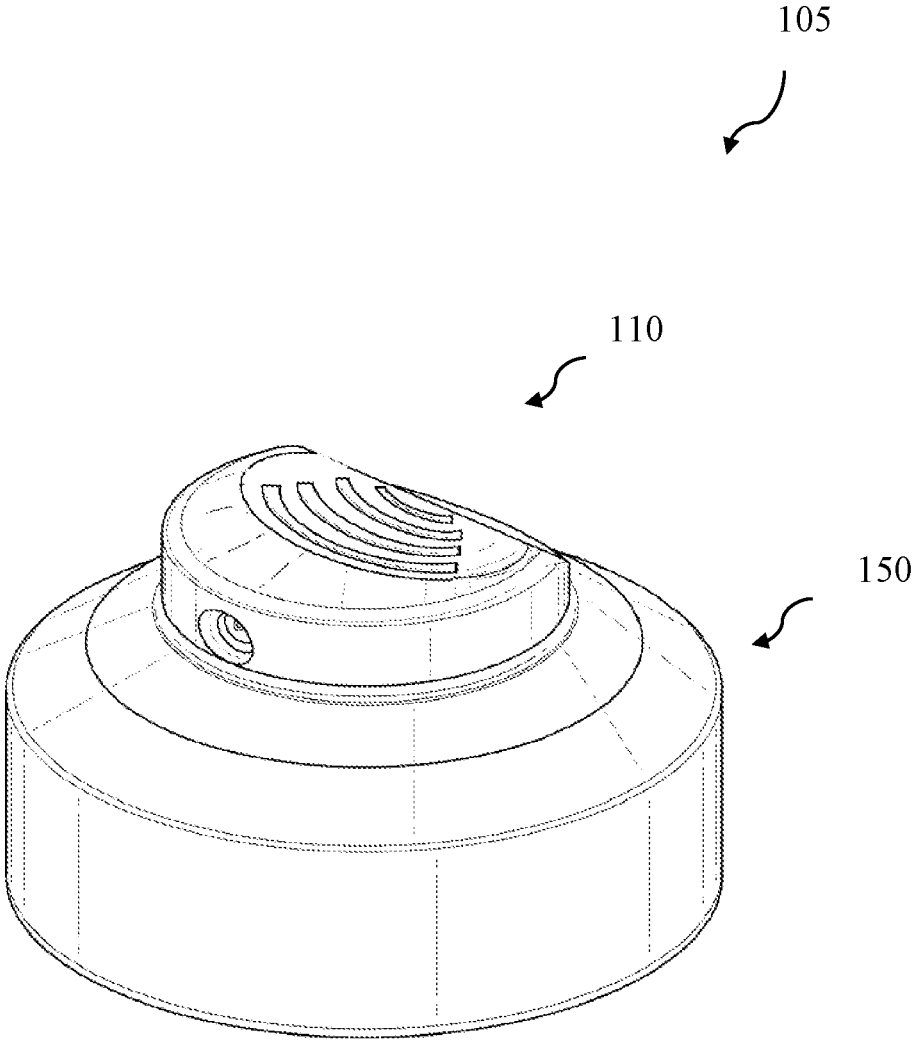
FIG. 3 is a left front perspective view showing an actuator for discharging an aerosol product from a canister according to our disclosure.
Figure 4:
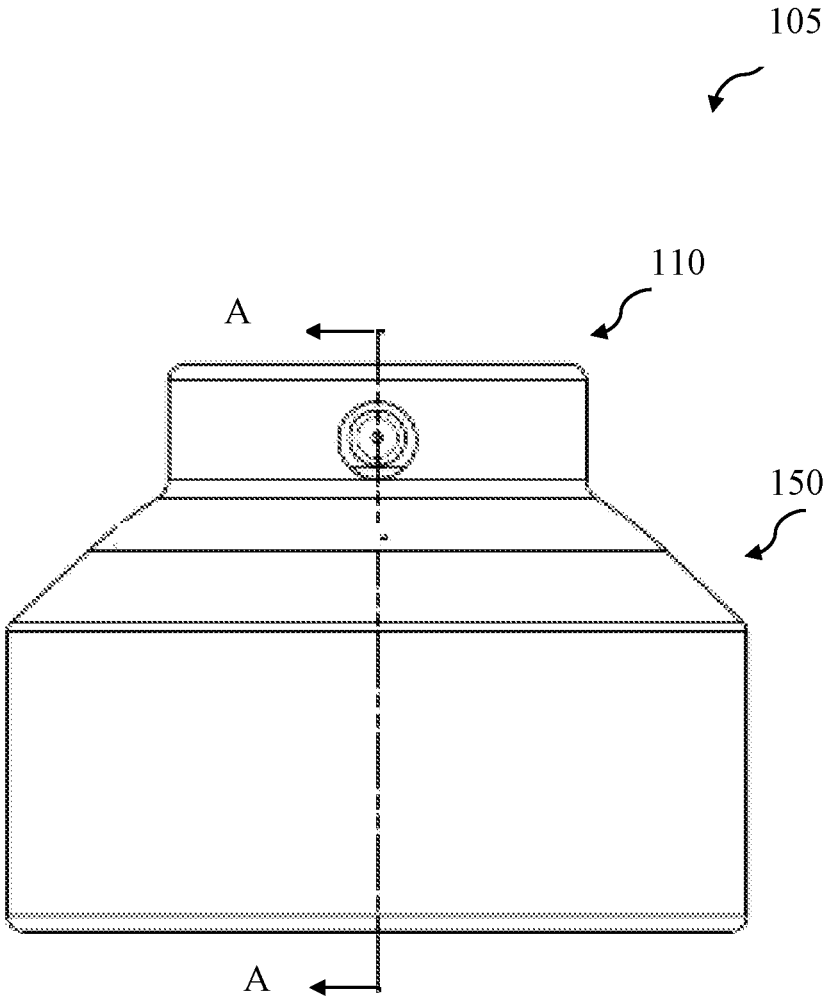
FIG. 4 is a front elevation view of the actuator of FIG. 3.
Figure 5:
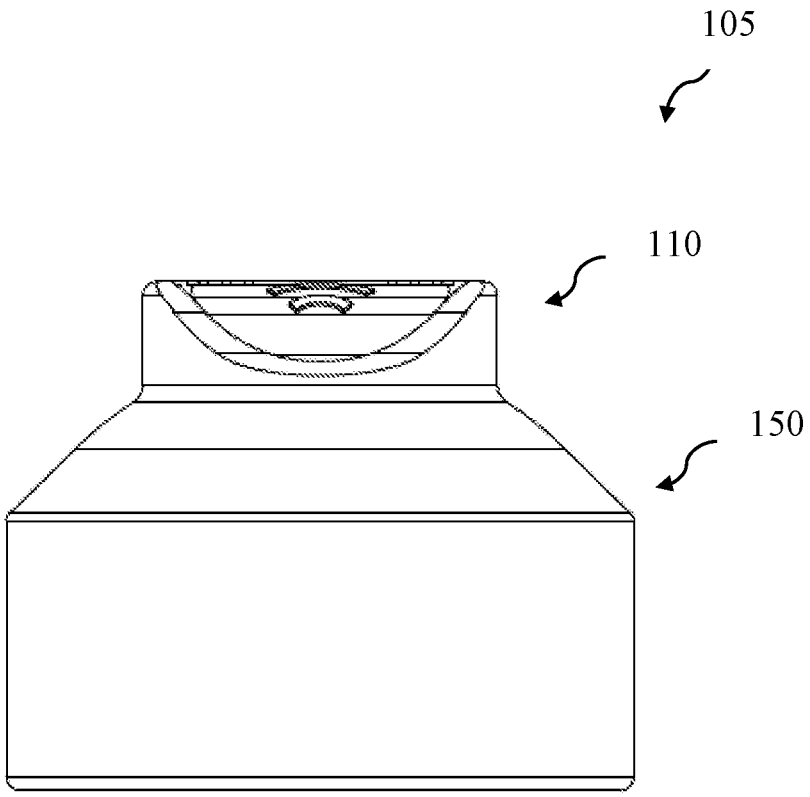
FIG. 5 is a rear elevation view of the actuator of FIG. 3.
Figure 6:
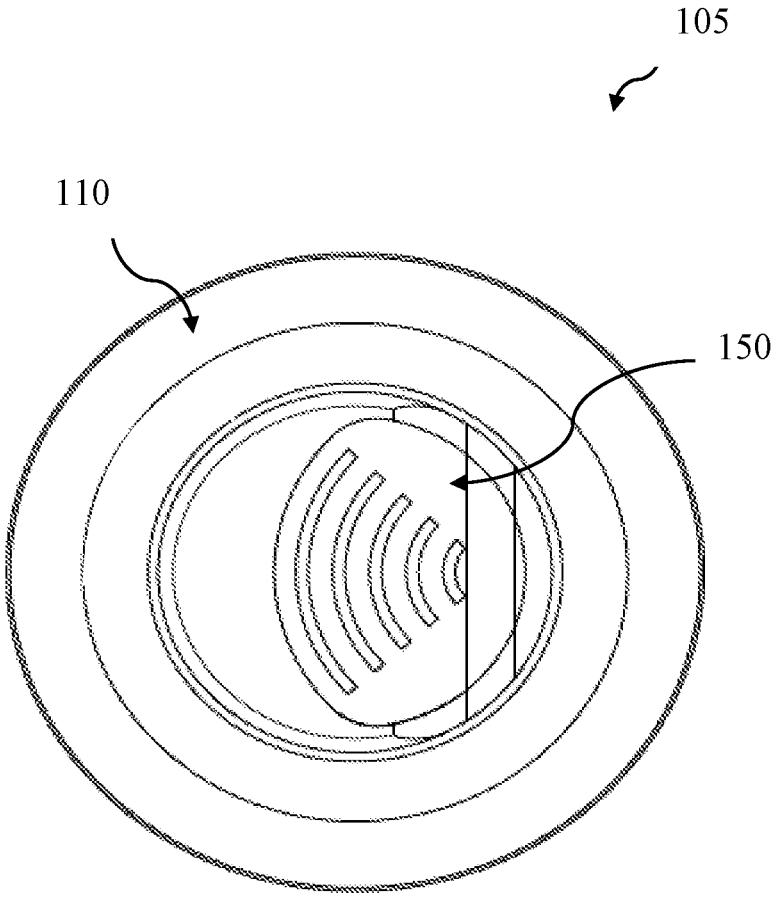
FIG. 6 is a top plan view of the actuator of FIG. 3 with the front of the actuator facing to the left.
Figure 7:
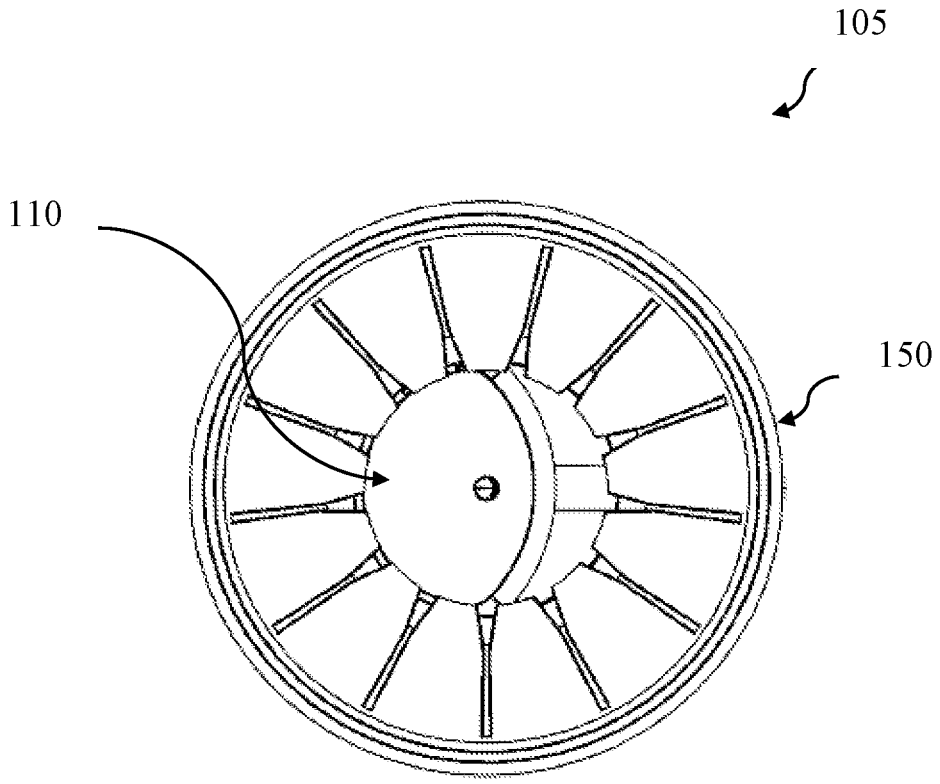
FIG. 7 is a bottom plan view of the actuator of FIG. 3 with the front of the actuator facing to the right.
Figure 8:
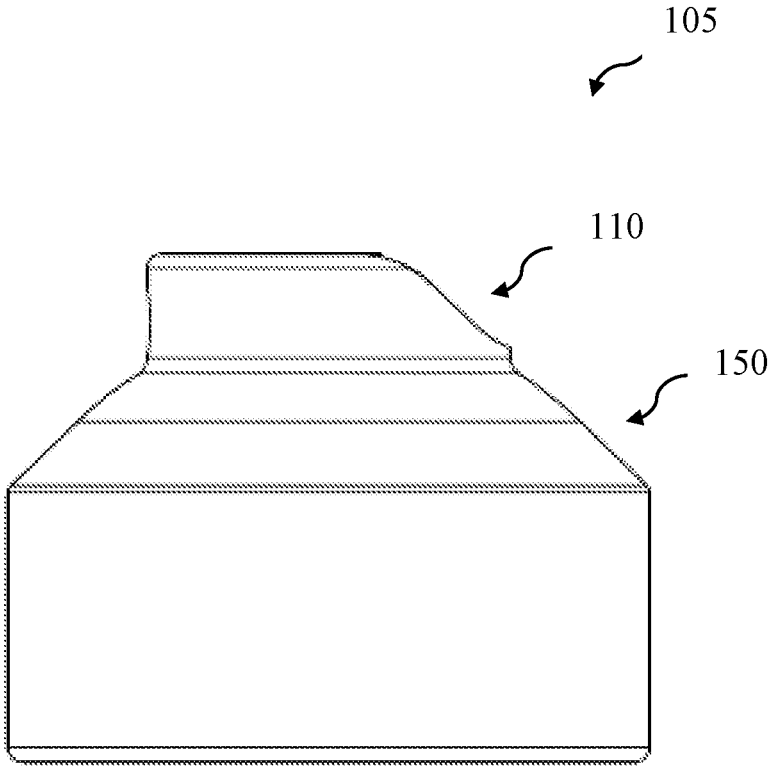
FIG. 8 is a left side elevation view of the actuator of FIG. 3 with the front of the actuator facing to the left.
Figure 9:
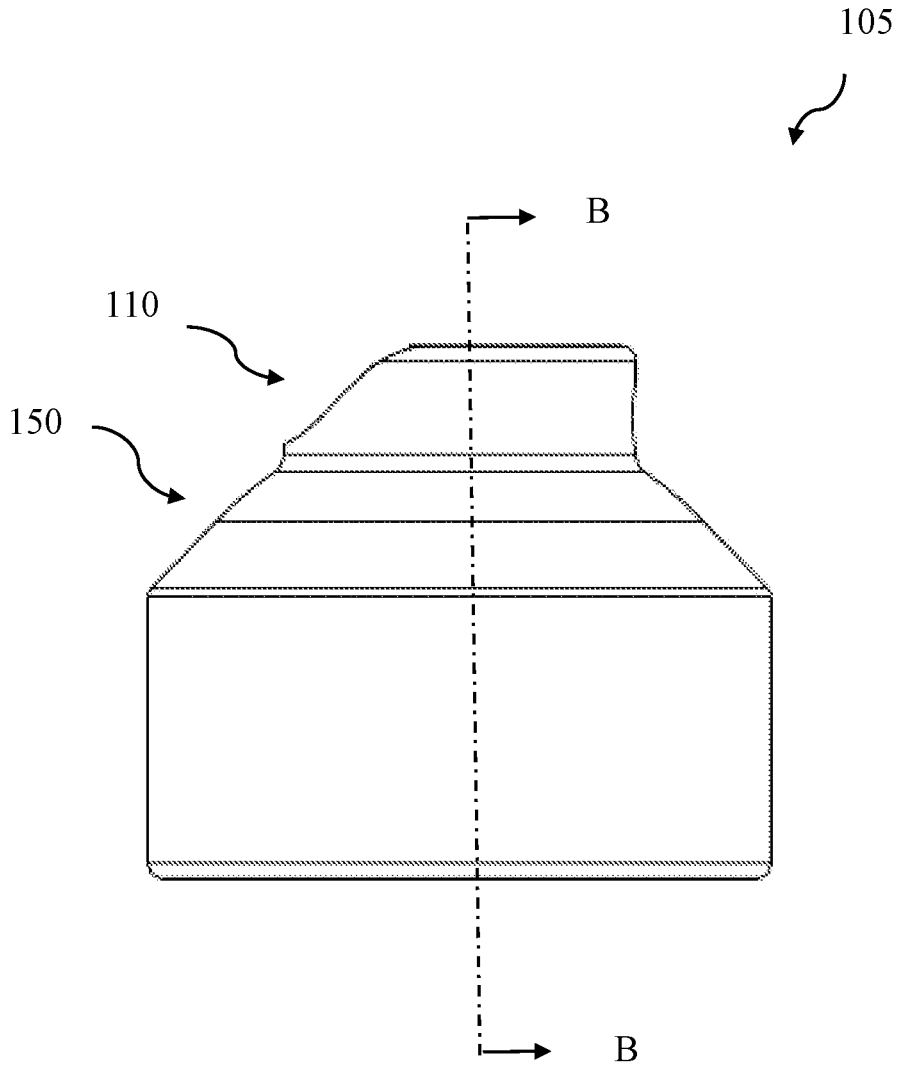
FIG. 9 is a right side elevation view of the actuator of FIG. 3 with the front of the actuator facing to the right.
Figure 10:
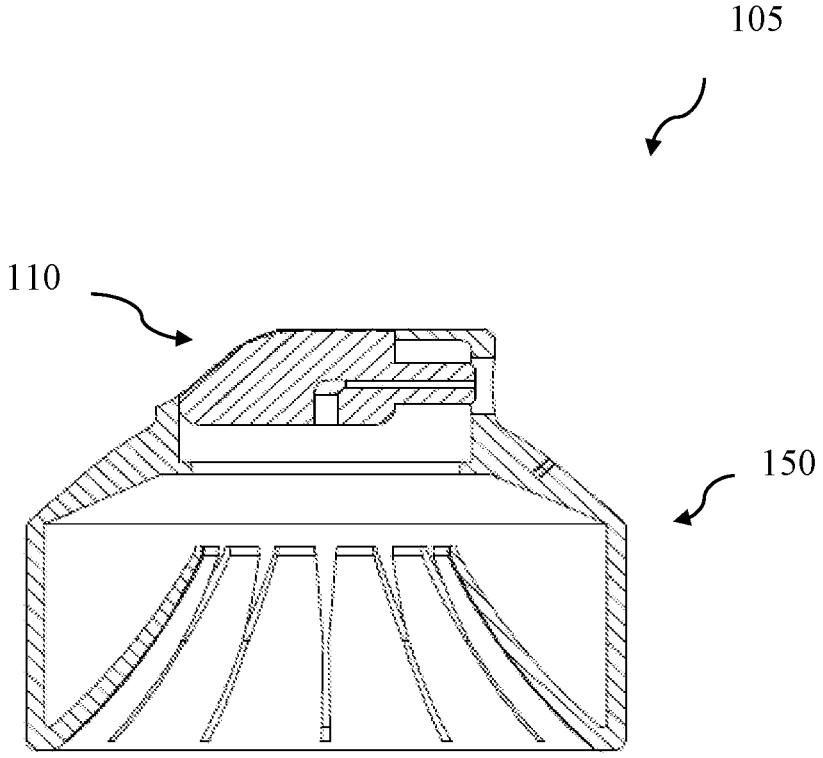
FIG. 10 is a cross sectional view of the actuator of FIG. 4 taken along lines A-A with the front of the actuator facing to the right.
Figure 11:
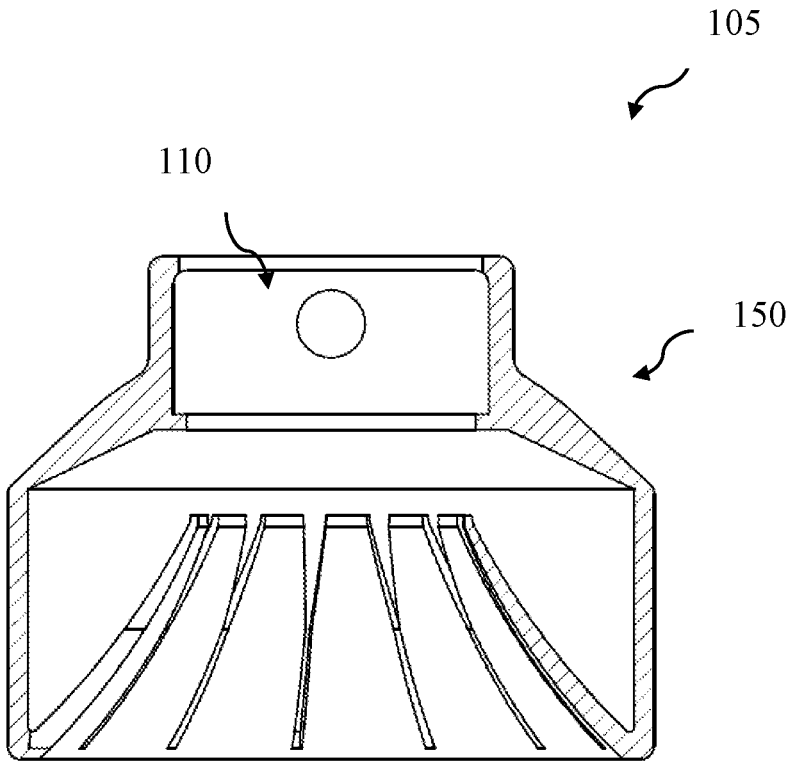
FIG. 11 is a cross sectional view of the actuator of FIG. 9 taken along lines B-B with the front of the actuator facing to the front.

More specifically, FIGS. 3-11 depict the actuator 105 for discharging an aerosol product from a canister according to our disclosure. FIG. 3 is a left front perspective view showing actuator 105 for discharging an aerosol product from a canister according to our disclosure. FIG. 4 is a front elevation view of the actuator of FIG. 3. FIG. 5 is a rear elevation view of the actuator of FIG. 3. FIG. 6 is a top plan view of the actuator of FIG. 3 with the front of the actuator facing to the left. FIG. 7 is a bottom plan view of the actuator of FIG. 3 with the front of the actuator facing to the right. FIG. 8 is a left side elevation view of the actuator of FIG. 3 with the front of the actuator facing to the left. FIG. 9 is a right side elevation view of the actuator of FIG. 3 with the front of the actuator facing to the right. FIG. 10 is a cross sectional view of the actuator of FIG. 4 taken along lines A-A with the front of the actuator facing to the right. FIG. 11 is a cross sectional view of the actuator of FIG. 9 taken along lines B-B with the front of the actuator facing to the front.

Figure 12:
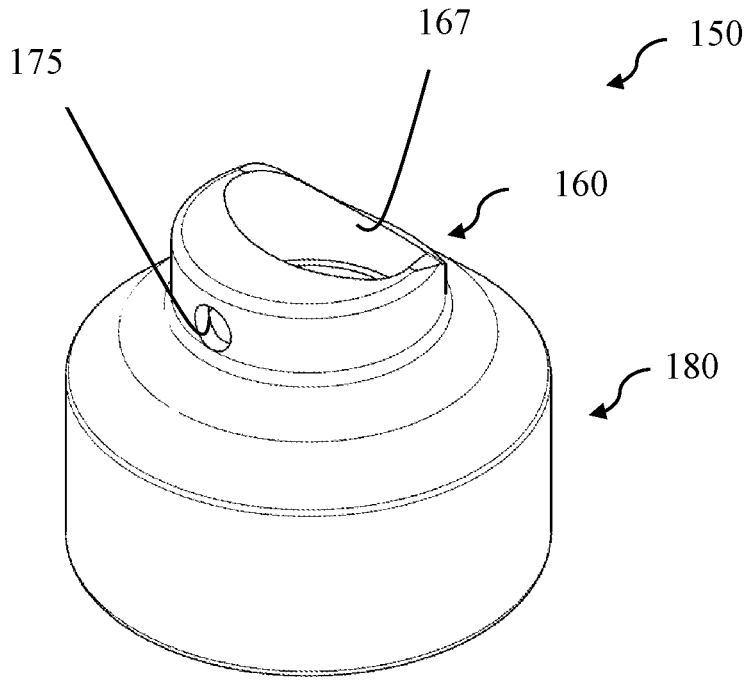
FIG. 12 is a left front perspective view showing a housing component of the actuator for discharging an aerosol product from a canister according to our disclosure.
Figure 13:
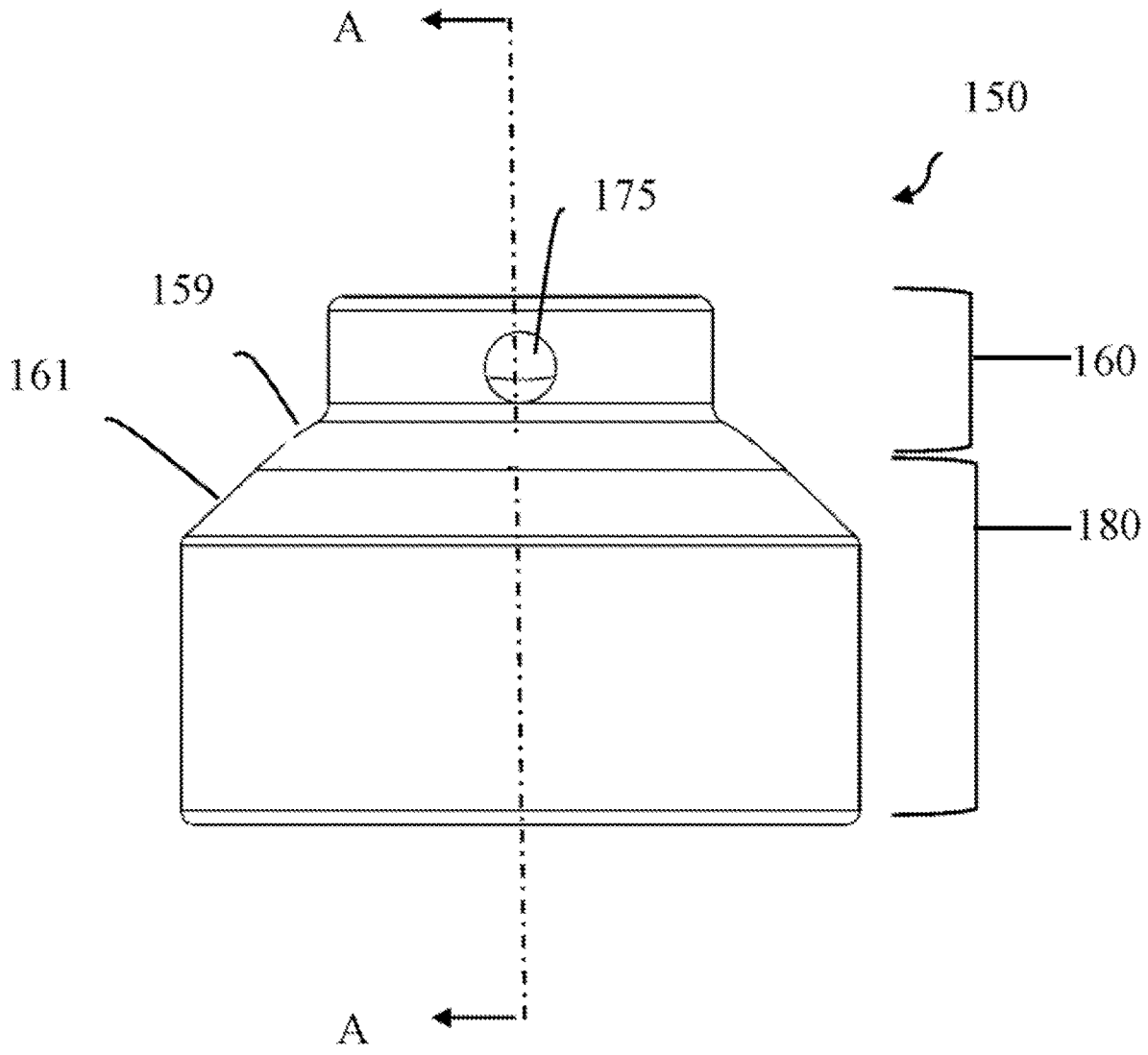
FIG. 13 is a front elevation view of the housing component of FIG. 12.
Figure 14:
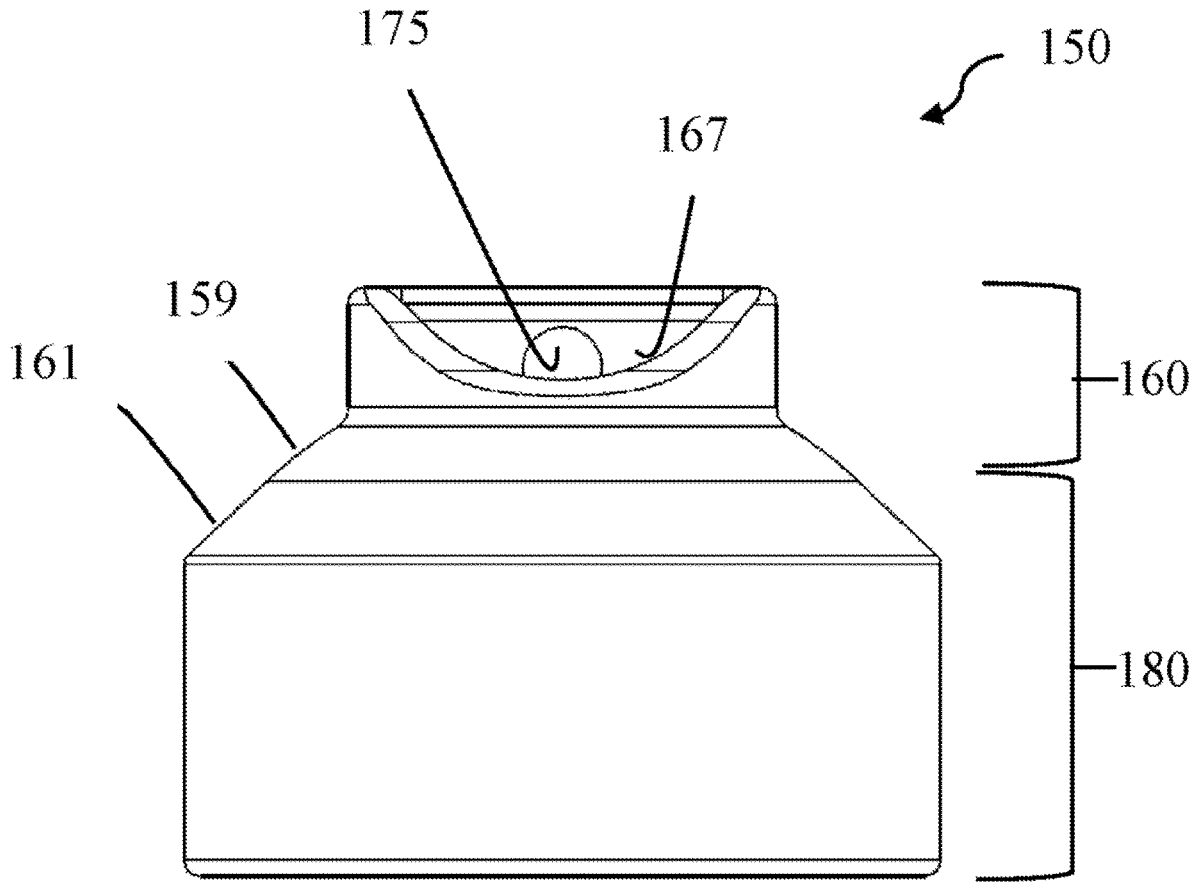
FIG. 14 is a rear elevation view of the housing component of FIG. 12.
Figure 15:
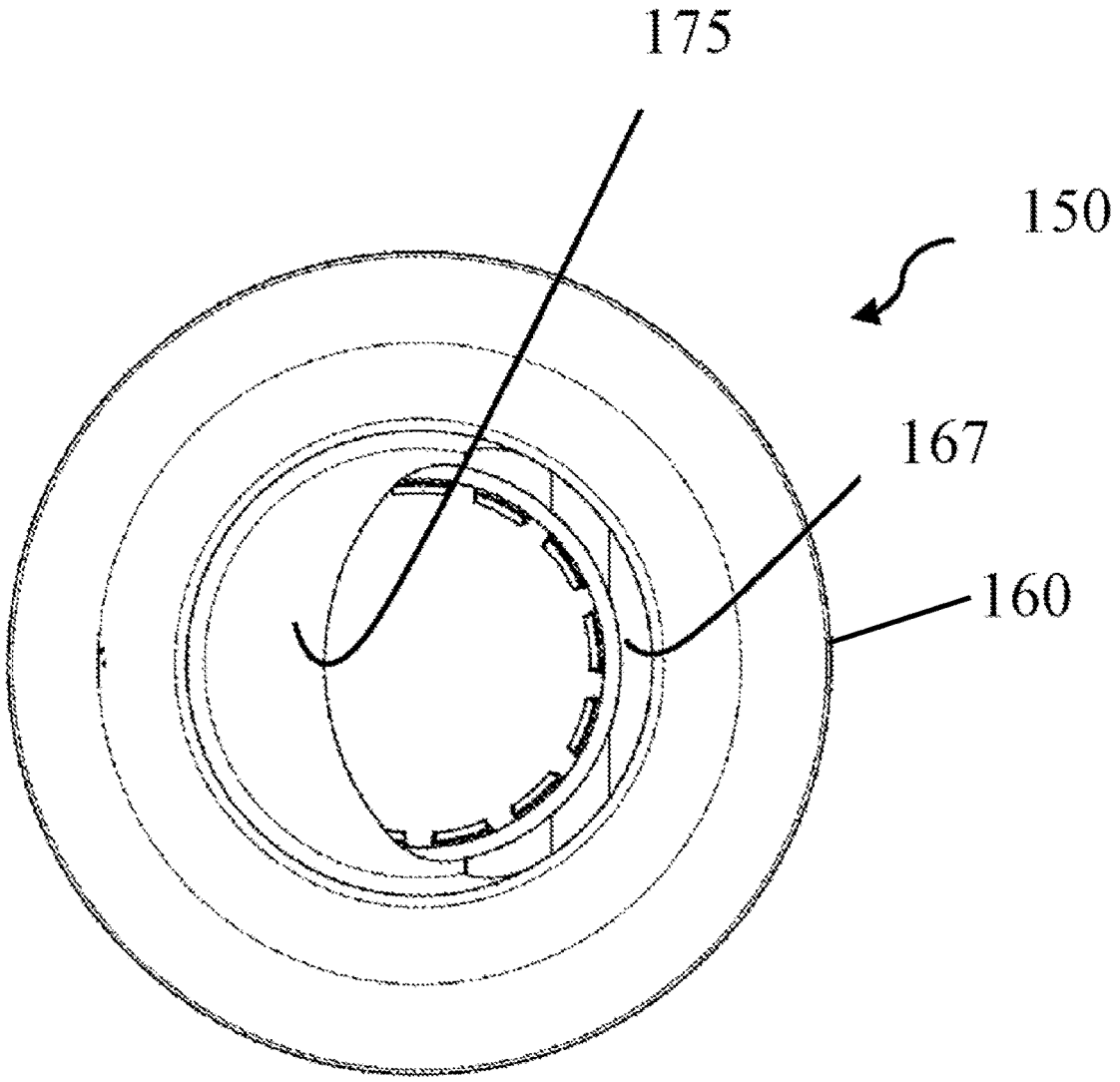
FIG. 15 is a top plan view of the housing component of FIG. 10 with the front of device facing to the left.
Figure 16:
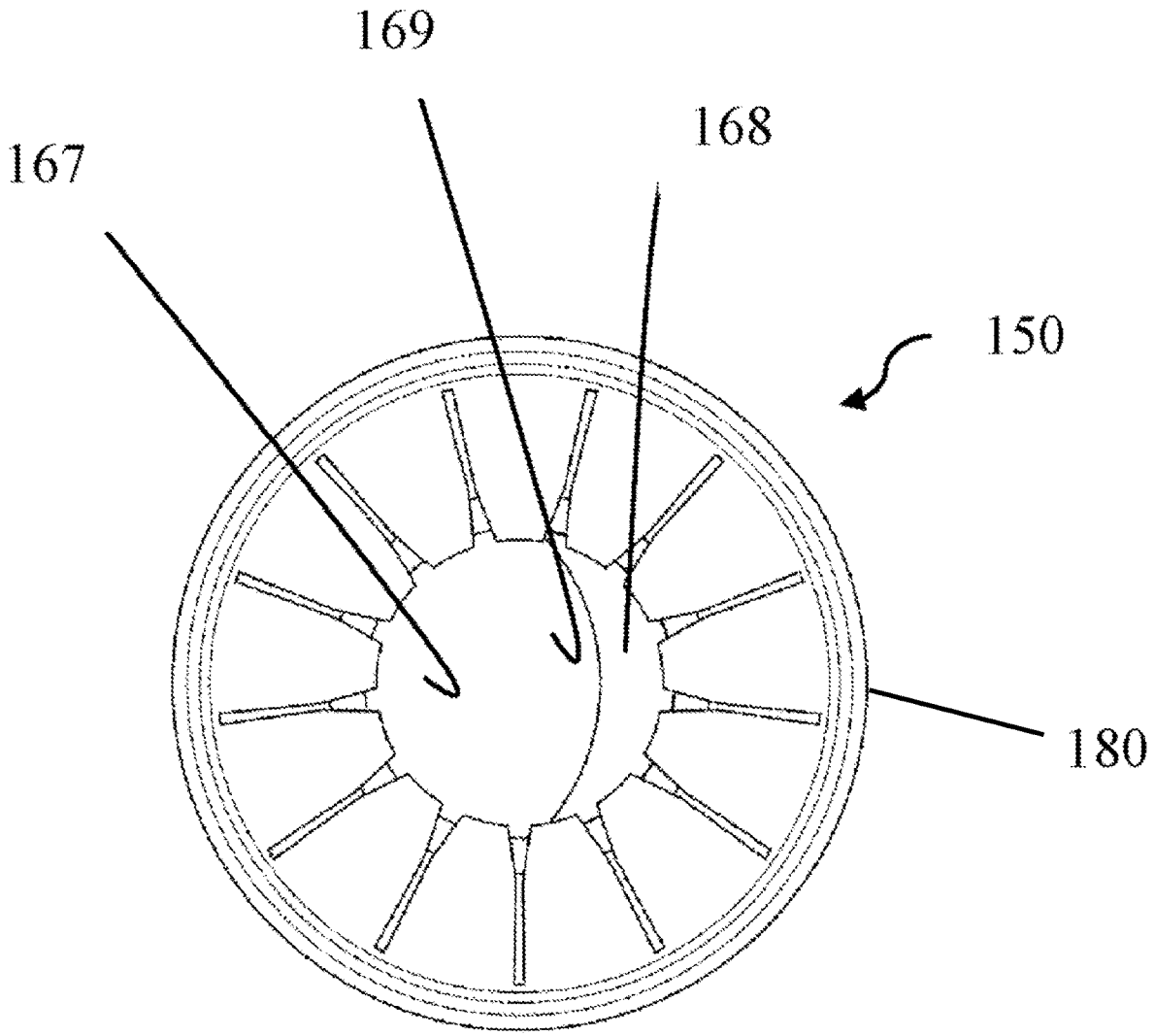
FIG. 16 is a bottom plan view of the housing component of FIG. 12 with the front of the device facing to the right.
Figure 17:
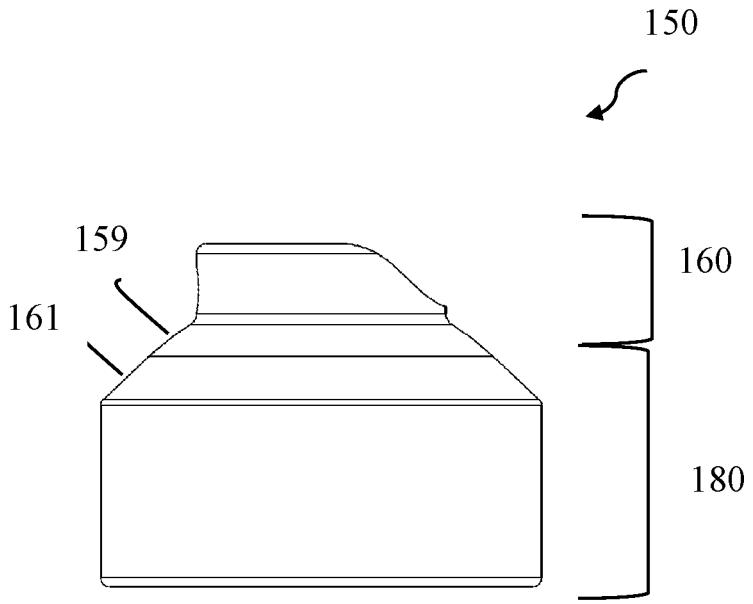
FIG. 17 is a left side elevation view of the housing component of FIG. 12 with the front of the housing component facing to the left.
Figure 18:
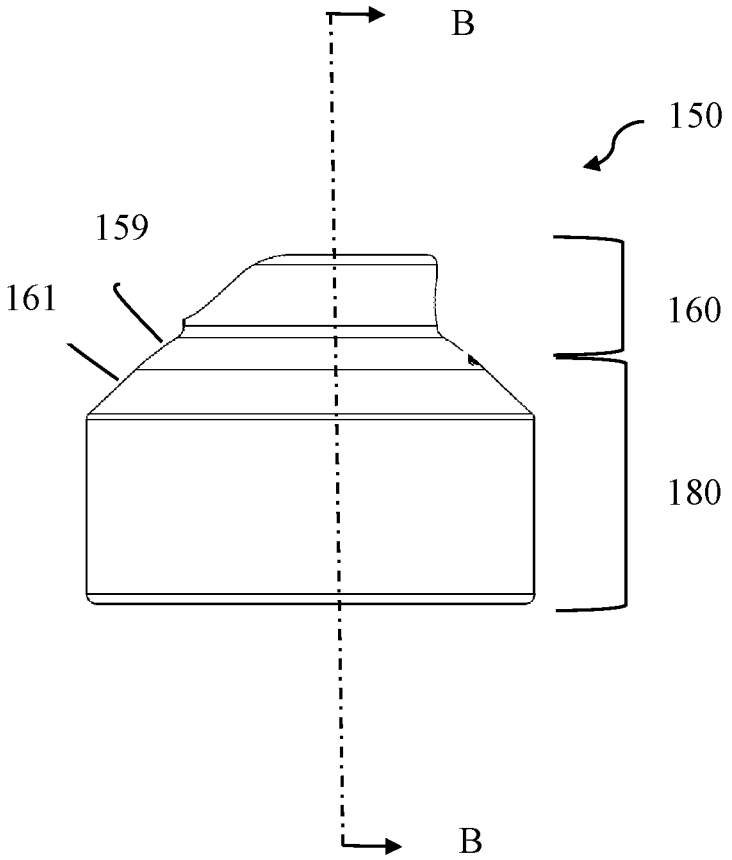
FIG. 18 is a right side elevation view of the housing component of FIG. 12 with the front of the housing component facing to the right.
Figure 19:
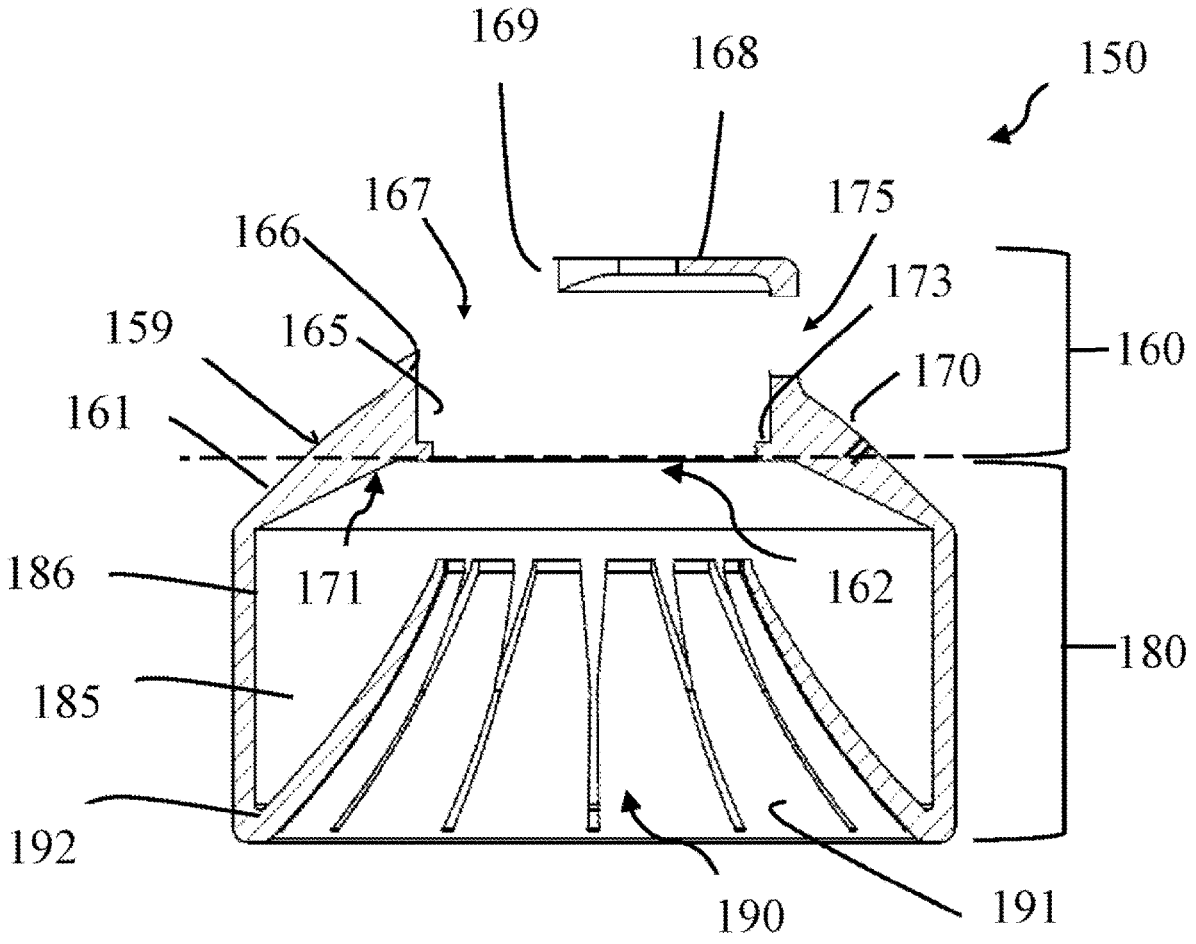
FIG. 19 is a cross sectional view of the housing component of FIG. 13 taken along lines A-A with the front of the housing component facing to the right
Figure 20:
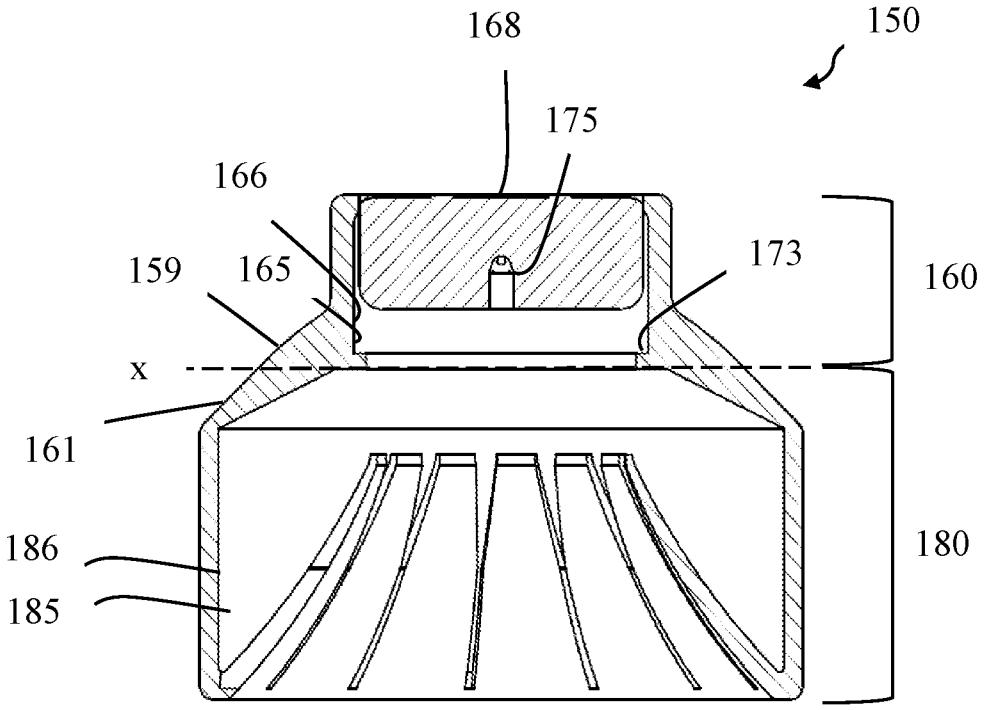
FIG. 20 is a cross sectional view of the housing component of FIG. 18 generally taken along lines B-B with the front of the housing component facing to the front.

FIGS. 12-20 depict a housing 150 of the actuator 105 depicted in FIG. 3 for discharging an aerosol product from a canister according to our disclosure. FIG. 12 is a left front perspective view showing the housing component 150 of the actuator 105 for discharging an aerosol product from a canister according to our disclosure. FIG. 13 is a front elevation view of the housing component of FIG. 12. FIG. 14 is a rear elevation view of the housing component of FIG. 12. FIG. 15 is a top plan view of the housing component of FIG. 10 with the front of device facing to the left. FIG. 16 is a bottom plan view of the housing component of FIG. 12 with the front of the device facing to the right. FIG. 17 is a left side elevation view of the housing component of FIG. 12 with the front of the housing component facing to the left. FIG. 18 is a right side elevation view of the housing component of FIG. 12 with the front of the housing component facing to the right. FIG. 19 is a cross sectional view of the housing component of FIG. 13 taken along lines A-A with the front of the housing component facing to the right. FIG. 20 is a cross sectional view of the housing component of FIG. 18 generally taken along lines B-B with the front of the housing component facing to the front.

Figure 21:
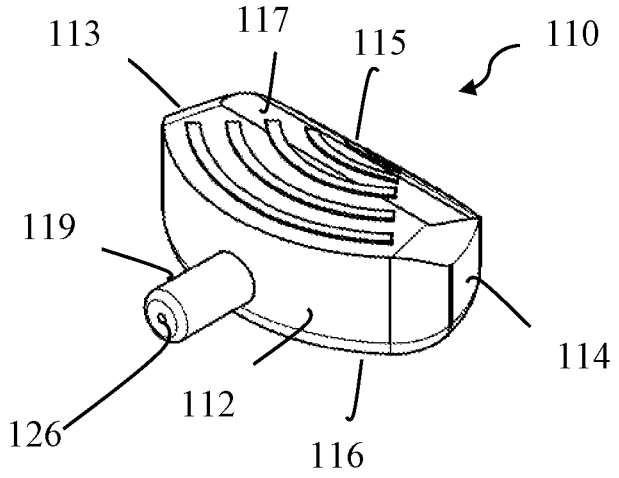
FIG. 21 is a left front perspective view showing a plunger component of the actuator for discharging an aerosol product from a canister according to our disclosure.
Figure 22:
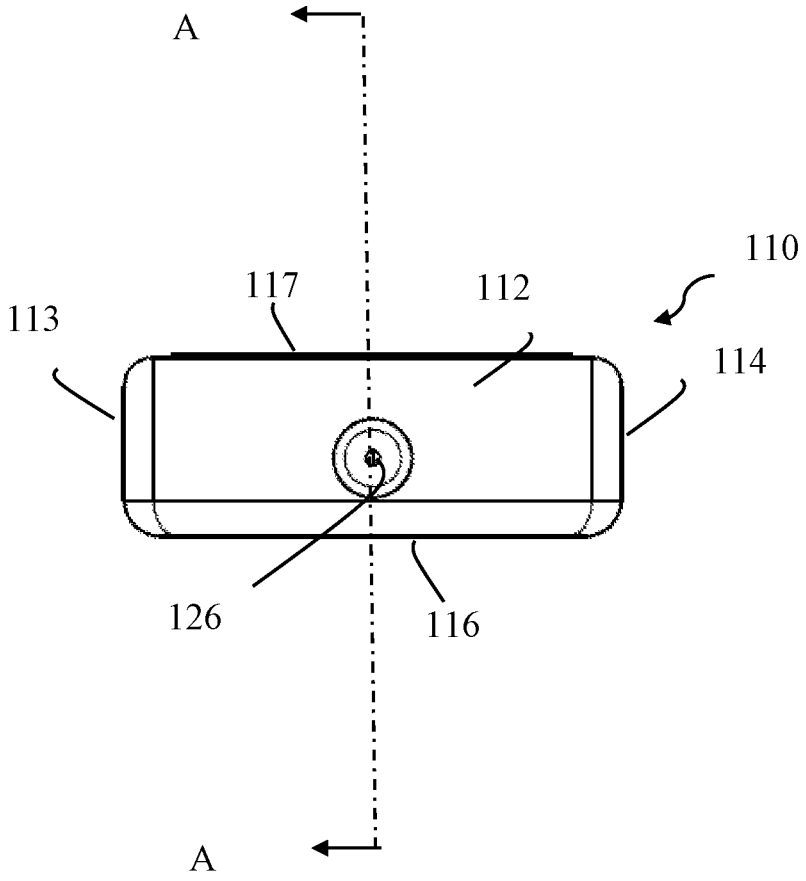
FIG. 22 is a front elevation view of the plunger component of FIG. 21.
Figure 23:
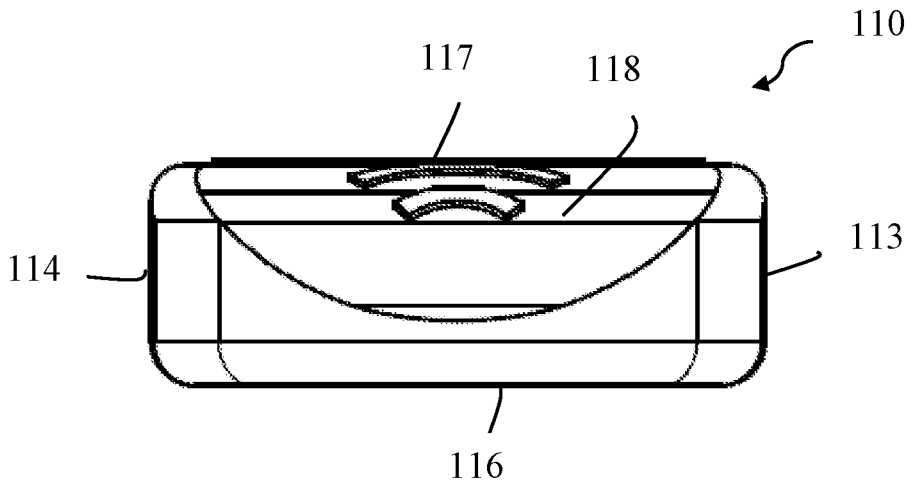
FIG. 23 is a rear elevation view of the plunger component of FIG. 21.
Figure 24:
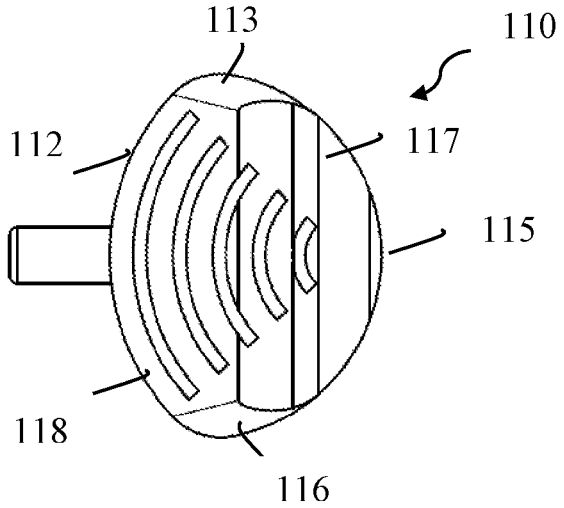
FIG. 24 is a top plan view of the plunger component of FIG. 21 with the front of the plunger component facing to the left.
Figure 25:
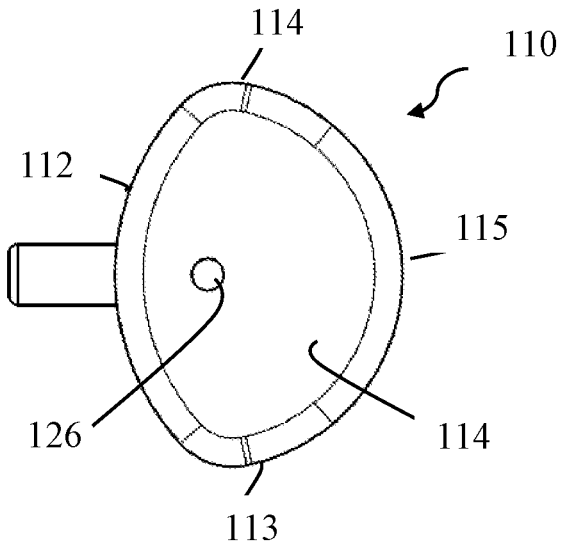
FIG. 25 is a bottom plan view of the plunger component of FIG. 21 with the front of the plunger component facing to the left.
Figure 26:
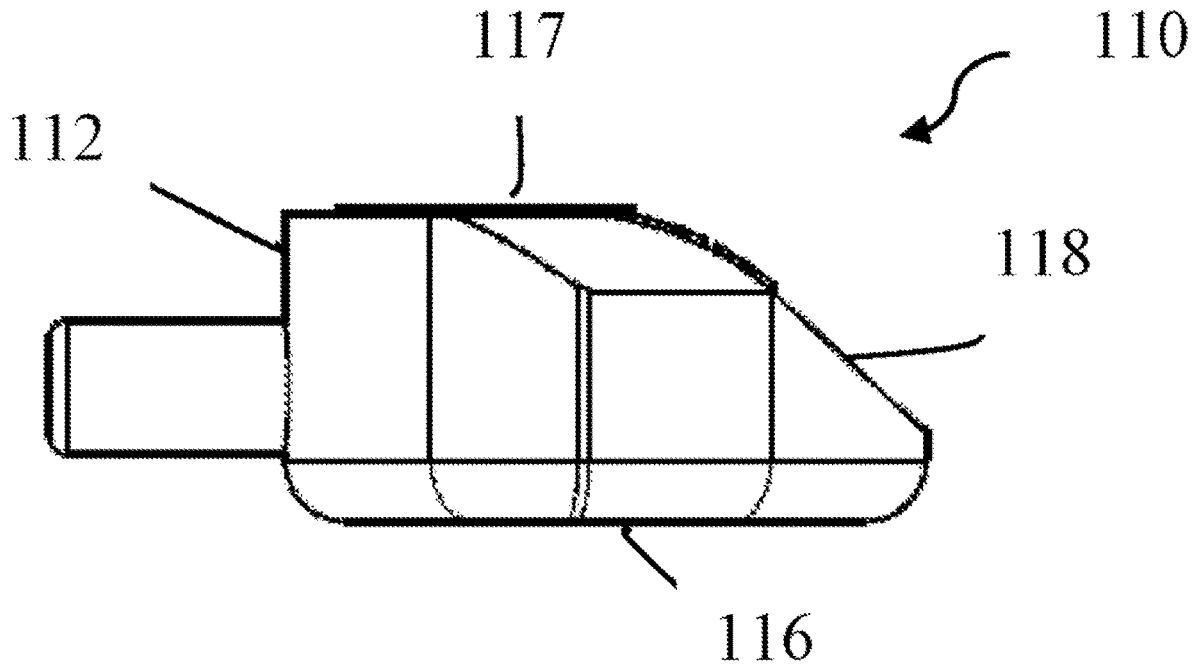
FIG. 26 is a left side elevation view of the plunger component of FIG. 21 with the front of the plunger component facing to the left.
Figure 27:
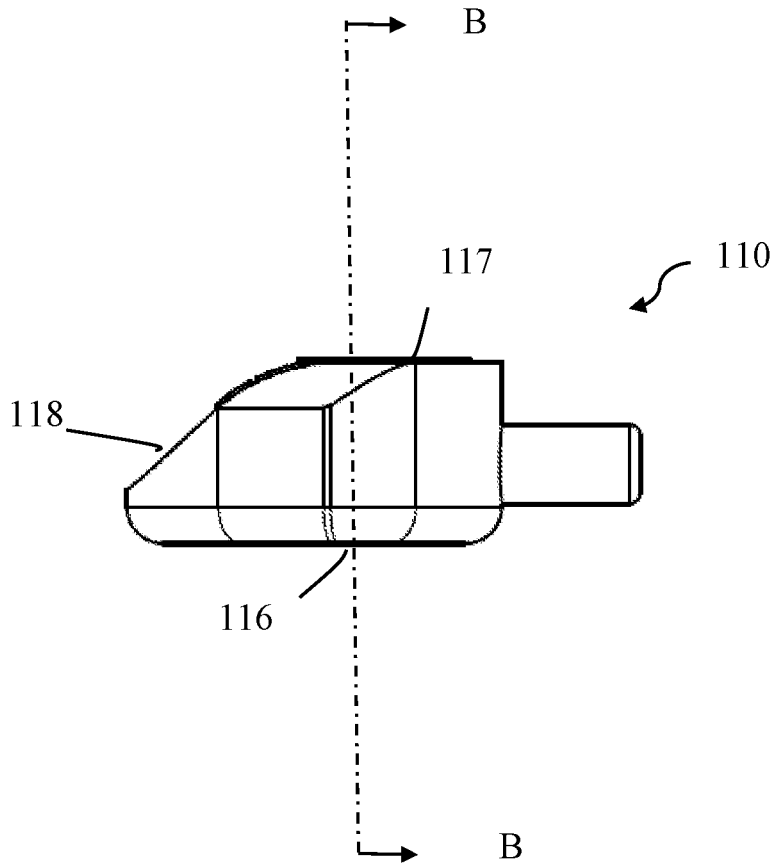
FIG. 27 is a right side elevation view of the plunger component of FIG. 21 with the front of the plunger component facing to the right.
Figure 28:
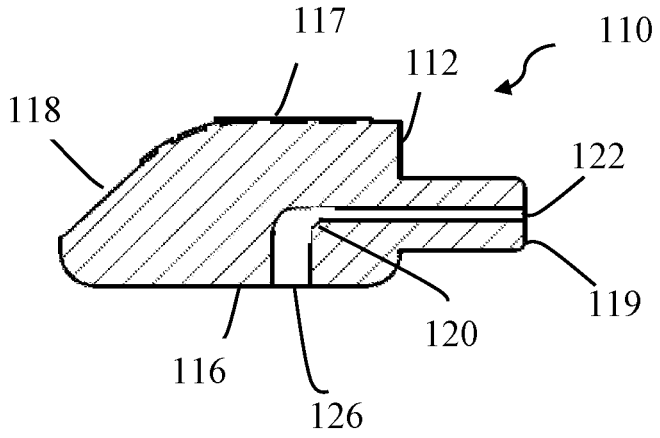
FIG. 28 is a cross sectional view of the plunger component of FIG. 22 taken along lines A-A with the front of the plunger component facing to the right.
Figure 29:
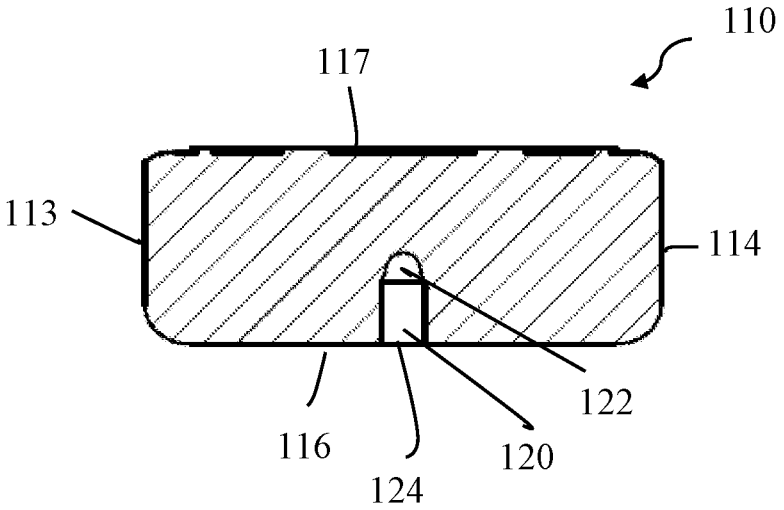
FIG. 29 is a cross sectional view the plunger component of FIG. 27 generally taken along lines B-B with the front of the plunger component facing to the front.

FIGS. 21-29 show a plunger 110 of the actuator 105 depicted in FIG. 3 for discharging an aerosol product from a canister according to our disclosure. FIG. 21 is a left front perspective view showing a plunger component of the actuator for discharging an aerosol product from a canister according to our disclosure. FIG. 22 is a front elevation view of the plunger component of FIG. 21. FIG. 23 is a rear elevation view of the plunger component of FIG. 21. FIG. 24 is a top plan view of the plunger component of FIG. 21 with the front of the plunger component facing to the left. FIG. 25 is a bottom plan view of the plunger component of FIG. 21 with the front of the plunger component facing to the left. FIG. 26 is a left side elevation view of the plunger component of FIG. 21 with the front of the plunger component facing to the left. FIG. 27 is a right side elevation view of the plunger component of FIG. 21 with the front of the plunger component facing to the right. FIG. 28 is a cross sectional view of the plunger component of FIG. 22 taken along lines A-A with the front of the plunger component facing to the right. FIG. 29 is a cross sectional view the plunger component of FIG. 27 generally taken along lines B-B with the front of the plunger component facing to the front.

Figure 30:
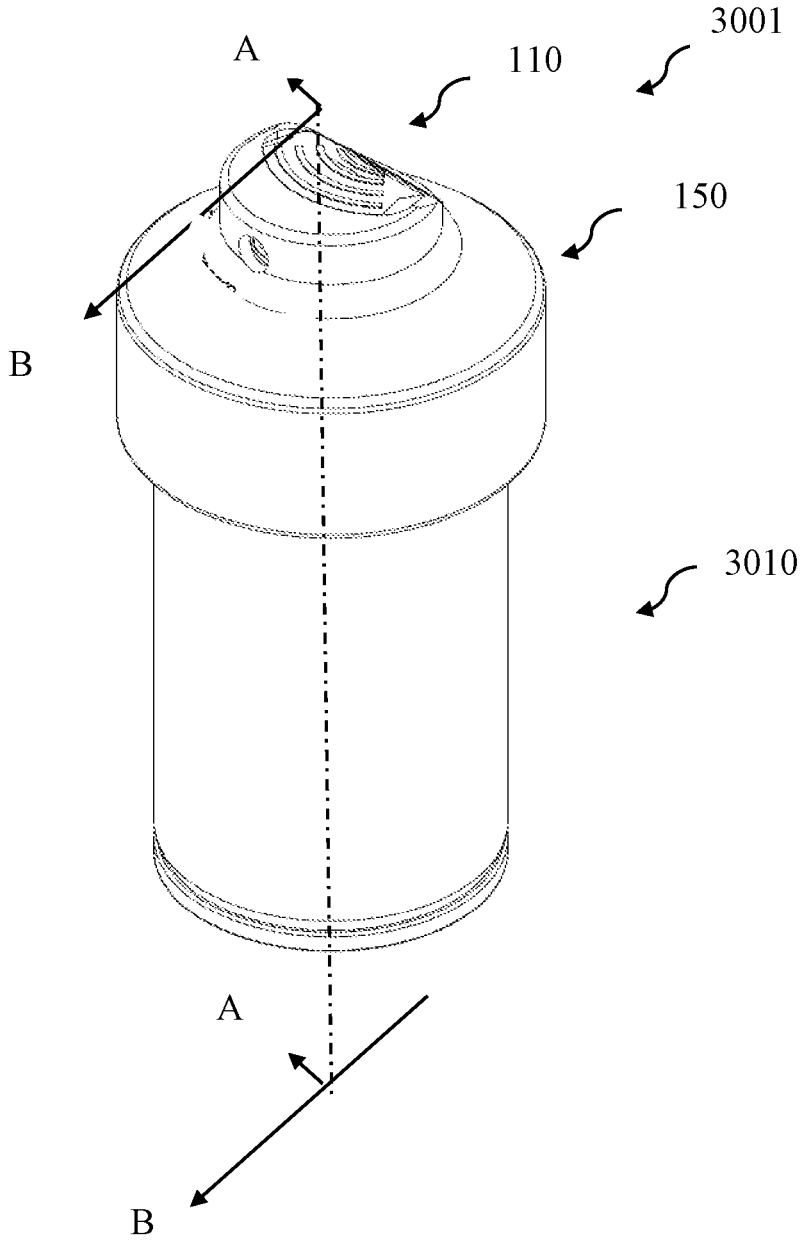
FIG. 30 is a left front perspective view showing an actuator for discharging an aerosol product from a canister attached to the canister according to our disclosure.
Figure 31:
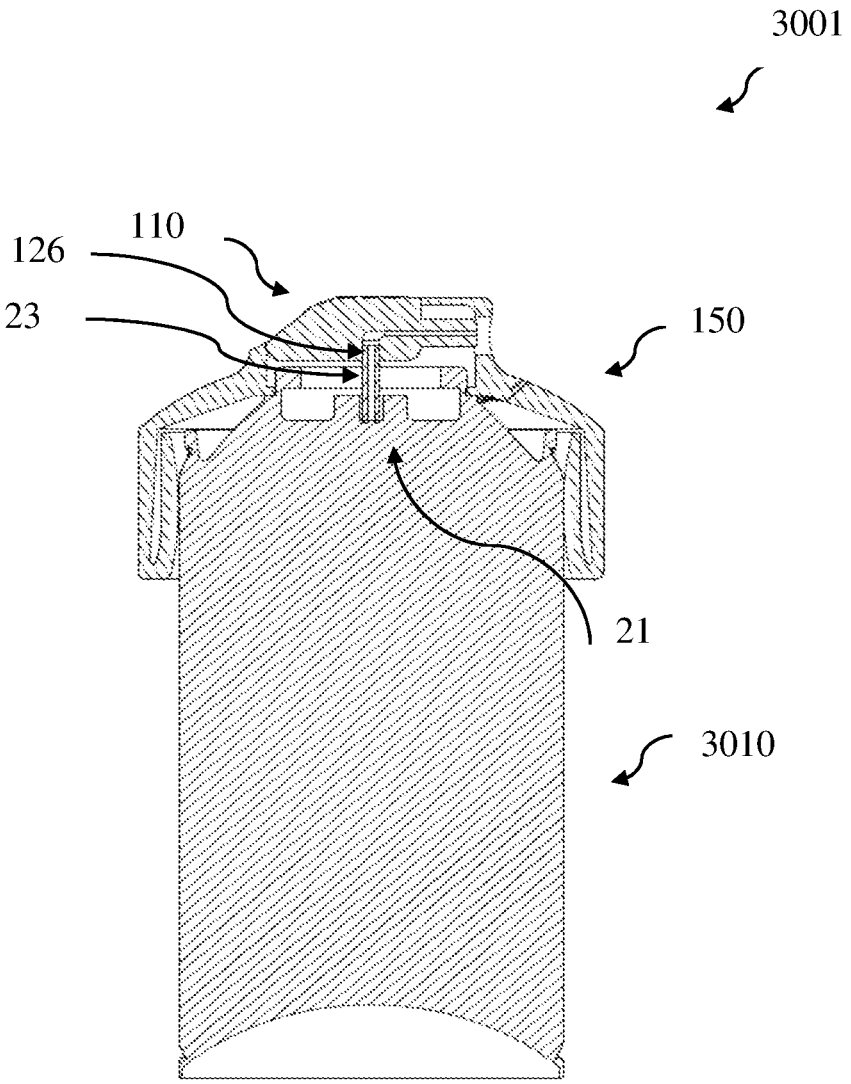
FIG. 31 is a cross sectional view of the actuator attached to the container of FIG. 30 taken along lines A-A with the front of the actuator facing to the right.
Figure 32:
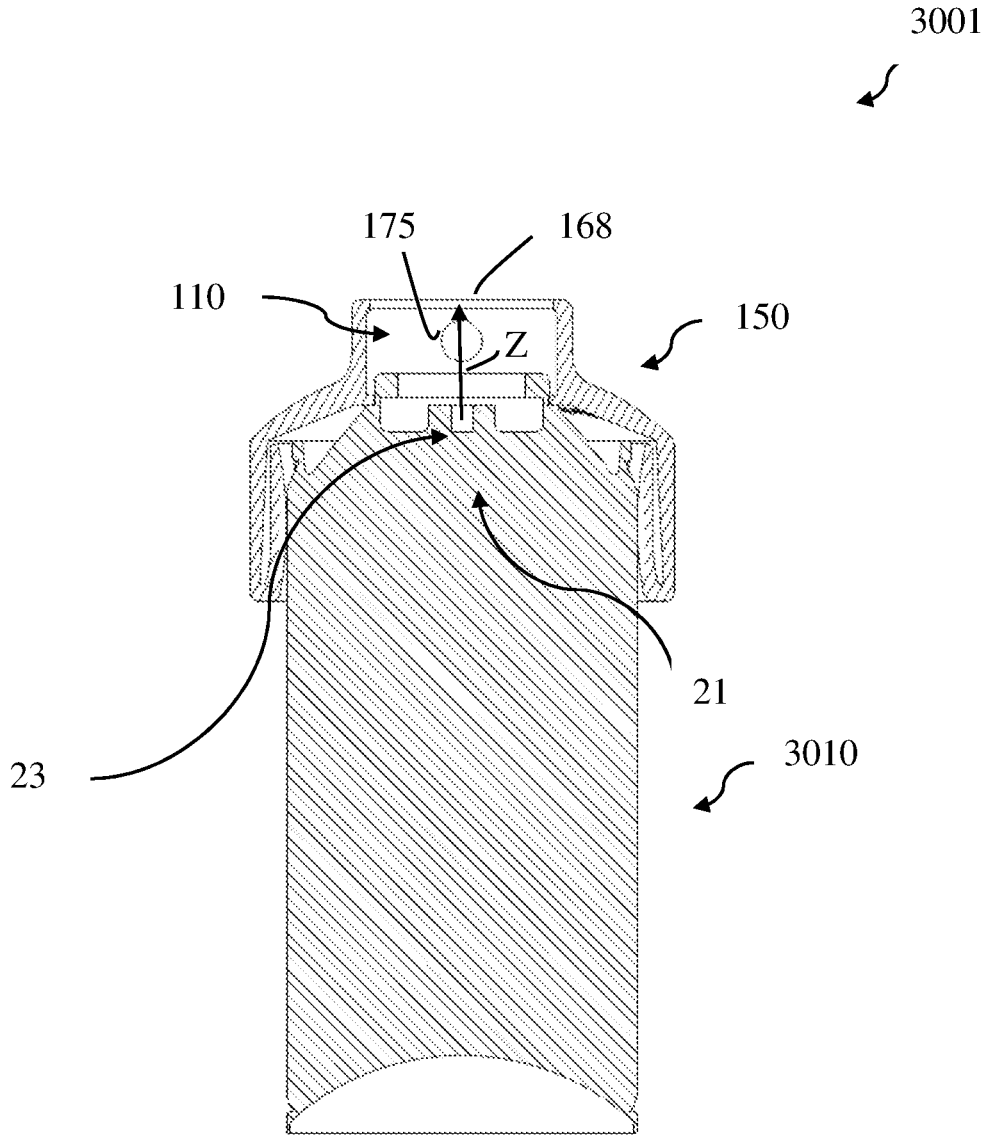
FIG. 32 is a cross sectional view of the actuator attached to the container of FIG. 30 taken along lines B-B with the front of the actuator facing to the front.
Figure 33:
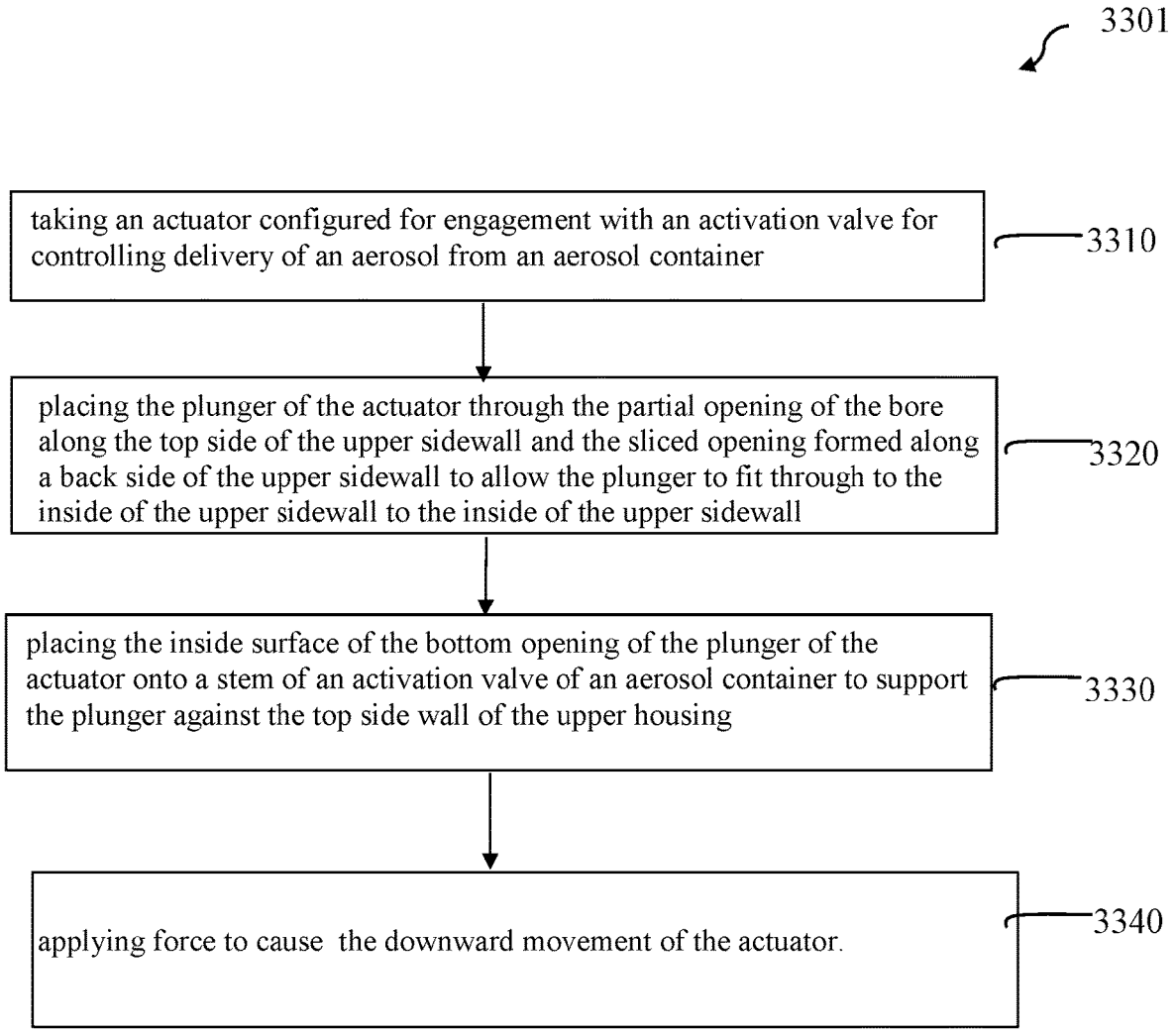
FIG. 33 shows a method of this disclosure.

FIGS. 30-32 depict an actuator 105 for discharging an aerosol product from a container attached to the canister according to our disclosure. FIG. 30 is a left front perspective view showing an actuator for discharging an aerosol product from a canister attached to the canister according to our disclosure. FIG. 31 is a cross sectional view of the actuator attached to the container of FIG. 30 taken along lines A-A with the front of the actuator facing to the right. FIG. 32 is a cross sectional view of the actuator attached to the container of FIG. 30 taken along lines B-B with the front of the actuator facing to the front.

As shown in the FIGS. 21-29, the plunger 110 (of actuator 105 depicted in FIG. 3 et seq.) includes a front side 112 including a curved front surface and a protruding member 119, opposing sides 114, 116 including opposing surfaces, a back side 118 including a back surface, and a bottom side 116 including bottom surface. A channel 120 extends through the plunger 110 from the front side 112 of the plunger through the protruding member 119 to the bottom side of the plunger 116. The channel defines a ventral opening 122 extending along the front side 112 of the plunger 110 and a dorsal opening 126 extending along the bottom side of the plunger.

The ventral opening 122 extending along a front side of the plunger 110 may be fitted to include an orifice valve insert of a particular size and shape to deliver the desired aerosol concentration, spray pattern and particle size. The particle orifice valve that may be fitted into the ventral opening 122 is a matter of design choice.

As shown in the FIGS. 21-29, the top side 117 of the plunger 110 may include a downwardly tapered top surface 118.

As shown in FIGS. 12-20, the housing component 150 (of actuator 105 depicted in FIG. 3) includes an upper sidewall 160 and a lower sidewall 180.

The upper sidewall 160 extends along a top portion of the housing component 150. A bore 165 extends through the upper sidewall 160 from the top to the bottom side of the upper sidewall 160 along an inside surface 166 of the upper sidewall 160. A top side wall 168 extends along the top side of the upper sidewall 160 from a front side 170 of the upper sidewall 160 to partially cover and form a partial opening 169 of the bore along the top side of the upper sidewall. A stop ledge 173 extends along a bottom side of the upper sidewall. A ventral opening 175 (the opening is depicted from the front surface of the upper sidewall overlaying the cross-sectional view otherwise shown) extends along a front side of the upper sidewall, and a diagonal sliced opening 167 formed along a back side of the upper sidewall.

The stop ledge 173 of the upper sidewall 160 is illustratively an annular ring that substantially circumscribes the bottom side of the upper sidewall 160. Alternatively, the stop ledge 173 of the upper sidewall 160 may be a plurality of stop ledges encircling the lower or higher sides of the upper sidewall 160.

A lower sidewall 180 extends along a bottom portion of the housing 150. The lower sidewall 180 defines a bore 185 and a releasable holding mechanism 190. The bore 185 extends through the lower sidewall 180 from the top to the bottom side of the lower sidewall 180 along an inside surface 186 of the lower sidewall. The releasable holding mechanism 190 extends along an inside surface 186 of the lower sidewall 180 along the bore. The bore opens along a top side 171 of the lower sidewall into the opening 162 of the bore of the upper sidewall. The bore 185 is configured for receiving an aerosol container (see aerosol container 3010 in FIGS. 30-32). The releasable holding mechanism 190 is configured to securely hold the housing 150 to an aerosol container (see aerosol container 3010 in FIGS. 30-32) during delivery of aerosol from an aerosol container and to release an aerosol container after delivery of aerosol from an aerosol container.

The releasable holding mechanism 190 extending along an inside surface 186 of the lower sidewall 180 along the bore 185 comprises a plurality of finger members 191. The plurality of finger members 191 extend away from a lower portion 192 of the inside surface 186 of the lower sidewall 180 into the bore 185 of the lower sidewall 180 in the direction of the top of the lower sidewall 180. Alternatively, the plurality of finger members 191 may extend away from above a lower portion of the inside surface of the lower sidewall into the bore of the lower sidewall. In another embodiment, the plurality of finger members extend in the direction of the bottom of the lower sidewall.

The partial opening 169 of the bore along the top side of the upper sidewall 160 and the sliced opening 167 formed along a back side of the upper sidewall 160 allows the plunger 110 to fit through to the inside of the upper sidewall 160.

The ventral opening 175 of the upper sidewall 160 allows the protruding member 119 of the plunger to extend therethrough.

As shown in FIGS. 13, 14, 17-20, diagonally extending surface 159 extending along a bottom portion of the inner sidewall 160 may adjoin a diagonally extending surface 161 extending along a top portion of the lower sidewall to form a smooth transition along the outer surface of the housing 150 between the upper sidewall 150 and the lower sidewall 160.

The inside surface of the dorsal opening 126 of the plunger 110 is configured to receive and be supported by a prior art stem 23 of a prior art activation valve 21 of an aerosol container (see aerosol container 3010 in FIGS. 30-32) which pushes Z the plunger 110 against the top side wall 168 of the upper housing 110 as depicted in FIG. 32.

As shown in the FIGS. 12-20, the top side 117 of the plunger 110 may include a downwardly tapered top surface 118.

On application of a force against the plunger 110 of the actuator 105, the actuator 105 is configured to push the prior art stem 23 (see aerosol container 3010 in FIGS. 30-32) of the prior art activation valve 21 down to release aerosol from an aerosol can through the dorsal opening 126 of the plunger 110, the channel 120 and the ventral opening 122 of the plunger 110.

The downward movement of the actuator 110 under the influence of the applied force is stopped by the step ledge 173 of the upper housing 160. On relaxation of a force applied to the actuator 105, the plunger 110 of the actuator 105 is configured to cause the stem (see aerosol container 3010 in FIGS. 30-32) of the activation valve 21 to return to its normal position to stop release of aerosol from an aerosol container 3010.

The actuator 110 of this disclosure is designed and configured to replace the actuator 22 depicted in the prior art described in connection with FIGS. 1 and 2 that typically comes with the activation device. Replacement of the prior art actuator 22 of the kind depicted in illustrated in FIGS. 1 and 2 with the actuator 22 of this disclosure may occur when the prior art actuator 22 of the kind depicted in FIGS. 1 and 2 are misplaced, lost, or abandoned in favor of using the actuator 2 of this disclosure which provides many benefits.

Among the benefits of the actuator 22 of our disclosure is this. Unlike conventional actuators which are typically customized for an integrated activation device for an aerosol container, the actuator of this disclosure is friendlier to the hand and generally agnostic to customization making it readily useable with a wide range of activation devices. The size of the actuator makes it harder to lose or misplace and easier to service. These aspects may contribute to a longer life for aerosol containers, a reduction in discarded product from unusable containers, a reduction in discarded materials from discarded aerosol containers, fewer aerosol containers populating the ecosystem since fewer replacements needed, and a component of a size that is easier to remove, clean, and replace.

The actuator 110 of our disclosure may be configured for use with an aerosol selected from the group consisting of paint, a detergent, a hairspray, a double phase aerosol, a single phase aerosol, a dual purpose air freshener/disinfectant, an odor remover/eliminator, a bathroom and tile cleaner, a disinfectant spray, a dusting aid, a general purpose cleaners, a general purpose degreaser, a glass cleaner spray, a metal polish/cleanser spray, an oven or grill cleaner, a sanitizer, a toilet/urinal care product, a wood cleaner, a motor vehicle wash, a rubber/vinyl protectant, an anti-static product, an anti-static product, a carpet & upholstery cleaner, a fabric protectant, a fabric refresher, a spot remover, a crawling bug insecticide, a flying bug insecticide, an insect repellant, a lawn or garden insecticide, a laundry prewash, a spot remover, an engine degreaser, an anti-seize lubricant, a cutting or tapping oil, a gear lubricant, a chain lubricant, a wire lubricant, a rubber and vinyl protectant, a rust preventative or rust control lubricant, a graffiti remover, a paint thinner, a shaving cream, a shaving gel, a footwear care product, a leather care product, and a furniture maintenance product.

The actuator 110 of our disclosure may be made from plastic or any other suitable material. The actuator is preferably a plastic (PET for example). Illustrative plastic may be PET (polyethylene terephthalate), or PEN (polyethylene naphtha late) or other plastics.

FIGS. 30-32 disclose an aerosol delivery system 3001 according to our disclosure. The aerosol delivery system 3001 includes the disclosed actuator 105 depicted in FIGS. 3-29 in combination with an activation valve 25 as previously described in combination with an aerosol container 3010. The actuator 105 for use in the system has been previously described. The retainer mechanism of the housing of the actuator releasably secures the housing to the container as shown in FIGS. 30-32. The operation of the aerosol delivery system 3001 has also been previously described. Previously described aspects of the actuator 105 and aerosol container assembly are further shown in FIGS. 30-32 which depict the actuator 105 for discharging an aerosol product from a container attached to the canister according to our disclosure. FIG. 30 is a left front perspective view showing an actuator for discharging an aerosol product from a canister attached to the canister according to our disclosure. FIG. 31 is a cross sectional view of the actuator attached to the container of FIG. 30 taken along lines A-A with the front of the actuator facing to the right. FIG. 32 is a cross sectional view of the actuator attached to the container of FIG. 30 taken along lines B-B with the front of the actuator facing to the front The method for delivering an aerosol from an aerosol container using the disclosed actuator 105 of this disclosure fully described above and includes (1) taking 3310 an actuator configured for engagement with an activation valve for controlling delivery of an aerosol from an aerosol container; (2) placing 3320 the plunger of the actuator through the partial opening of the bore along the top side of the upper sidewall and the sliced opening formed along a back side of the upper sidewall to allow the plunger to fit through to the inside of the upper sidewall to the inside of the upper sidewall; (3) placing 3330 the inside surface of the bottom opening of the plunger of the actuator onto a stem of an activation valve of an aerosol container to support the plunger against the top side wall of the upper housing; and (4) applying 3340 force to cause the downward movement of the actuator.

There is thus disclosed an actuator for engagement with an activation valve for controlling delivery of an aerosol from an aerosol container. The actuator includes a plunger and a housing.

The plunger includes a front side including a curved front surface and a protruding member, opposing sides including opposing surfaces, a back surface including a back surface, and a bottom side including a bottom surface. A channel extends through the plunger from the front side of the plunger through the protruding member to the bottom side of the plunger. The channel defines a ventral opening extending along the front side of the plunger and a dorsal opening extending along the bottom side of the plunger.

The housing is configured for attachment to an aerosol container. The housing includes an upper sidewall and a lower sidewall.

The upper sidewall extend along a top portion of the housing. A bore extends through the upper sidewall from the top to the bottom side of the upper sidewall along an inside surface of the upper sidewall. A top side wall extends along the top side of the upper sidewall from a front side of the upper sidewall to partially cover and form a partial opening of the bore along the top side of the upper sidewall. A stop ledge extends along a bottom side of the upper sidewall. A ventral opening extends along a front side of the upper sidewall, and a diagonal sliced opening formed along a back side of the upper sidewall.

A lower sidewall extends along a bottom portion of the housing. The lower sidewall defines a bore and a releasable holding mechanism. The bore extends through the lower sidewall from the top to the bottom side of the lower sidewall along an inside surface of the lower sidewall. The releasable holding mechanism extends an inside surface of the lower sidewall along the bore. The bore opens along the top side of the lower sidewall into the opening of the bore of the upper sidewall. The bore is configured for receiving an aerosol container. The releasable holding mechanism is configured to securely hold the housing to an aerosol container during delivery of aerosol from an aerosol container and to release an aerosol container after delivery of aerosol from an aerosol container.

The partial opening of the bore along a top side of the upper sidewall and the sliced opening formed along a back side of the upper sidewall allows the plunger to fit through to the inside of the upper sidewall.

The ventral opening of the upper sidewall allows the protruding member of the plunger to extend therethrough.

The inside surface of the dorsal opening of the plunger is configured to receive and be supported by prior art stem of a prior art activation valve of an aerosol container against the top side wall of the upper housing, On application of a force against the actuator, the plunger of the actuator is configured to push a stem of the activation valve down to release aerosol from an aerosol can through the dorsal opening, the channel and the ventral opening of the plunger.

The downward movement of the actuator under the influence of the applied force is stopped by the step ledge of the upper housing. On relaxation of a force applied to the actuator, the actuator is configured to cause the stem of the activation device to return to its normal position to stop release of aerosol from an aerosol can.

In another aspect, the ventral opening extending along a front side of the plunger includes an orifice valve.

In another aspect, the side of the plunger includes a downwardly tapered top surface.

In another aspect, the stop ledge of the upper sidewall is an annular ring that substantially circumscribes the bottom side of the upper sidewall In another aspect, the stop ledge of the upper sidewall is a plurality of stop ledges encircling the upper sidewall.

In another aspect, a diagonally extending surface extending along a bottom portion of the inner sidewall adjoins a diagonally extending surface extending along a top portion of the upper sidewall to form a smooth transition along the outer surface of the housing between the upper sidewall and the lower sidewall.

In another aspect, the releasable holding mechanism extending an inside surface of the lower sidewall along the bore comprises a plurality of finger members, the plurality of finger members extending away from a lower portion of the inside surface of the lower sidewall into the bore of the lower sidewall in the direction of the top of the lower housing.

In another aspect, the actuator is configured for use with an aerosol selected from the group consisting of paint, a detergent, a hairspray, a double phase aerosol, a single phase aerosol, a dual purpose air freshener/disinfectant, an odor remover/eliminator, a bathroom and tile cleaner, a disinfectant spray, a dusting aid, a general purpose cleaners, a general purpose degreaser, a glass cleaner spray, a metal polish/cleanser spray, an oven or grill cleaner, a sanitizer, a toilet/urinal care product, a wood cleaner, a motor vehicle wash, a rubber/vinyl protectant, an anti-static product, an anti-static product, a carpet & upholstery cleaner, a fabric protectant, a fabric refresher, a spot remover, a crawling bug insecticide, a flying bug insecticide, an insect repellant, a lawn or garden insecticide, a laundry prewash, a spot remover, an engine degreaser, an anti-seize lubricant, a cutting or tapping oil, a gear lubricant, a chain lubricant, a wire lubricant, a rubber and vinyl protectant, a rust preventative or rust control lubricant, a graffiti remover, a paint thinner, a shaving cream, a shaving gel, a footwear care product, a leather care product, and a furniture maintenance product.

In another aspect, an aerosol delivery system includes an actuator for engagement with an activation valve for controlling delivery of an aerosol from an aerosol container. The system includes an actuator, an activation device, and an aerosol container.

The actuator includes a plunger and a housing.

The plunger includes a front side including a curved front surface and a protruding member, opposing sides including opposing surfaces, a back surface including a back surface, and a bottom side including a bottom surface. A channel extends through the plunger from the front side of the plunger through the protruding member to the bottom side of the plunger. The channel defines a ventral opening extending along a front side of the plunger and a dorsal opening extending along the bottom side of the plunger.

The housing is configured for attachment to an aerosol container. The housing includes an upper sidewall extending along a top portion of the housing. A bore extends through the upper sidewall from the top to the bottom side of the upper sidewall along an inside surface of the upper sidewall. A top side wall extends along the top side of the upper sidewall from a front side of the upper sidewall to partially cover and form a partial opening of the bore along the top side of the upper sidewall. A stop ledge extends along a bottom side of the upper sidewall. A ventral opening extends along a front side of the upper sidewall, and a diagonal sliced opening formed along a back side of the upper sidewall.

A lower sidewall extends along a bottom portion of the housing. The lower sidewall defines a bore and a releasable holding mechanism. The bore extends through the lower sidewall from the top to the bottom side of the lower sidewall along an inside surface of the lower sidewall. The releasable holding mechanism extends an inside surface of the lower sidewall along the bore. The bore opens along the top side of the lower sidewall into the opening of the bore of the upper sidewall. The bore is configured for receiving an aerosol container. The releasable holding mechanism is configured to securely hold the housing to an aerosol container during delivery of aerosol from an aerosol container and to release an aerosol container after delivery of aerosol from an aerosol container.

The partial opening of the bore along the top side of the upper sidewall and the sliced opening formed along a back side of the upper sidewall allows the plunger to fit through to the inside of the upper sidewall.

The ventral opening of the upper sidewall allows the protruding member of the plunger to extend therethrough.

The inside surface of the dorsal opening of the plunger is configured to receive and be supported by a prior art stem of a prior art activation valve of an aerosol container against the top side wall of the upper housing, On application of a force against the actuator, the plunger of the actuator is configured to push a stem of the activation device down to release aerosol from an aerosol can through the dorsal opening, the channel and the ventral opening of the plunger.

The downward movement of the actuator under the influence of the applied force is stopped by the step ledge of the upper housing. On relaxation of a force applied to the actuator, the actuator is configured to cause the stem of the activation device to return to its normal position to stop release of aerosol from an aerosol can.

In another aspect, the ventral opening extends along the front side of the plunger includes an orifice valve insert.

In another aspect, a top side of the plunger includes a downwardly tapered top surface.

In another aspect, the stop ledge of the upper sidewall is an annular ring that substantially circumscribes the bottom side of the upper sidewall In another aspect, the stop ledge of the upper sidewall is a plurality of stop ledges encircling the upper sidewall.

In another aspect, a diagonally extending surface extending along a bottom portion of the inner sidewall adjoins a diagonally extending surface extending along a top portion of the upper sidewall to form a smooth transition along the outer surface of the housing between the upper sidewall and the lower sidewall.

In another aspect, the releasable holding mechanism extending an inside surface of the lower sidewall along the bore comprises a plurality of finger members, the plurality of finger members extending away from a lower portion of the inside surface of the lower sidewall into the bore of the lower sidewall in the direction of the top of the lower housing.

In another aspect, the actuator is configured for use with an aerosol selected from the group consisting of paint, a detergent, a hairspray, a double phase aerosol, a single phase aerosol, a dual purpose air freshener/disinfectant, an odor remover/eliminator, a bathroom and tile cleaner, a disinfectant spray, a dusting aid, a general purpose cleaners, a general purpose degreaser, a glass cleaner spray, a metal polish/cleanser spray, an oven or grill cleaner, a sanitizer, a toilet/urinal care product, a wood cleaner, a motor vehicle wash, a rubber/vinyl protectant, an anti-static product, an anti-static product, a carpet & upholstery cleaner, a fabric protectant, a fabric refresher, a spot remover, a crawling bug insecticide, a flying bug insecticide, an insect repellant, a lawn or garden insecticide, a laundry prewash, a spot remover, an engine degreaser, an anti-seize lubricant, a cutting or tapping oil, a gear lubricant, a chain lubricant, a wire lubricant, a rubber and vinyl protectant, a rust preventative or rust control lubricant, a graffiti remover, a paint thinner, a shaving cream, a shaving gel, a footwear care product, a leather care product, and a furniture maintenance product.

In another aspect, a method for delivering an aerosol from an aerosol container is disclosed. The method includes (1) taking an actuator for an activation device for controlling delivery of an aerosol from an aerosol container.

The plunger includes a front side including a curved front surface, opposing sides including opposing surfaces, a back surface including a back surface, and a bottom side including a bottom surface. A channel extends through the plunger from the front side of the plunger to the bottom side of the plunger. The channel defines a ventral opening extending along the front side of the plunger and a dorsal opening extending along the bottom side of the plunger.

The housing is configured for attachment to an aerosol container. The housing includes an upper sidewall extending along a top portion of the housing. A bore extends through the upper sidewall from the top to the bottom side of the upper sidewall along an inside surface of the upper sidewall. A top side wall extends along the top side of the upper sidewall from a front side of the upper sidewall to partially cover and form a partial opening of the bore along the top side of the upper sidewall. A stop ledge extends along a bottom side of the upper sidewall. A ventral opening extends along a front side of the upper sidewall, and a diagonal sliced opening formed along a back side of the upper sidewall.

A lower sidewall extends along a bottom portion of the housing. The lower sidewall defines a bore and a releasable holding mechanism. The bore extends through the lower sidewall from the top to the bottom side of the lower sidewall along an inside surface of the lower sidewall. The releasable holding mechanism extends an inside surface of the lower sidewall along the bore. The bore opens along the top side of the lower sidewall into the opening of the bore of the upper sidewall. The bore is configured for receiving an aerosol container. The releasable holding mechanism is configured to securely hold the housing to an aerosol container during delivery of aerosol from an aerosol container and to release an aerosol container after delivery of aerosol from an aerosol container.

The partial opening of the bore along the top side of the upper sidewall and the sliced opening formed along a back side of the upper sidewall allows the plunger to fit through to the inside of the upper sidewall.

The inside surface of the dorsal opening of the plunger is configured to receive and be supported by a stem of an actuator of an aerosol container against the top side wall of the upper housing.

In the method, (2) the plunger is placed through the partial opening of the bore along the top side of the upper sidewall and the sliced opening formed along a back side of the upper sidewall allows the plunger to fit through to the inside of the upper sidewall to the inside of the upper sidewall with the protruding member of the plunger extending through the ventral opening of the upper sidewall. (3) The inside surface of the bottom opening of the plunger is placed to receive and be supported by a prior art stem of a prior art activation valve of an aerosol container against the top side wall of the upper housing. (4) Force is applied to the plunger to cause the downward movement of the actuator.

In another aspect the method includes the step of stopping the downward movement of the actuator by the step ledge of the upper housing.

In another aspect the method includes the step of relaxing the force applied to the actuator, to cause the stem of the activation valve to return to its normal position to stop release of aerosol from an aerosol can.

Unlike conventional actuators which are typically customized for an integrated activation device for an aerosol container, the actuator of this disclosure is friendlier to the hand and generally agnostic to customization making it readily useable with a wide range of activation devices. The size of the actuator makes it harder to lose or misplace and easier to service. These aspects may contribute to a longer life for aerosol containers, a reduction in discarded product from unusable containers, a reduction in discarded materials from discarded aerosol containers, fewer aerosol containers populating the ecosystem since fewer replacements needed, and a component of a size that is easier to remove, clean, and replace.

While the disclosure has been described in conjunction with specific embodiments, it is evident that numerous alternatives, modifications, and variations will be apparent to those skilled in the art within the spirit and scope of the disclosure described above.

What is claimed is:

1. An actuator configured for engagement with an activation valve for controlling delivery of an aerosol from an aerosol container, the actuator comprising:

a plunger comprising a front side including a curved front surface and a protruding member, opposing sides including opposing surfaces, a back surface including a back surface, a bottom side including a bottom surface, a channel extending through the plunger from the front side of the plunger through the protruding member to the bottom side of the plunger, the channel defining a ventral opening extending along the front side of the plunger and a dorsal opening extending along the bottom side of the plunger; and a housing configured for attachment to an aerosol container, the housing comprising:

an upper sidewall extending along a top portion of the housing, a bore extending through the upper sidewall from the top to the bottom side of the upper sidewall along an inside surface of the upper sidewall, a top side wall extending along the top side of the upper sidewall from a front side of the upper sidewall to partially cover and form a partial opening of the bore along the top side of the upper sidewall, a stop ledge extending along a bottom side of the upper sidewall;

a ventral opening extending along a front side of the upper sidewall, and a diagonal sliced opening formed along a back side of the upper sidewall;

a lower sidewall extending along a bottom portion of the housing, the lower sidewall defining a bore and a releasable holding mechanism, the bore extending through the lower sidewall from the top to the bottom side of the lower sidewall along an inside surface of the lower sidewall, the releasable holding mechanism extending an inside surface of the lower sidewall along the bore, the bore opening along the top side of the lower sidewall into the opening of the bore of the upper sidewall, the bore configured for receiving an aerosol container, the releasable holding mechanism configured to securely hold the housing to an aerosol container during delivery of aerosol from an aerosol container and to release an aerosol container after delivery of aerosol from an aerosol container;

wherein the partial opening of the bore along the top side of the upper sidewall and the sliced opening formed along the back side of the upper sidewall allows the plunger to fit through to the inside of the upper side wall;

wherein, the ventral opening of the upper sidewall allows the protruding member of the plunger to extend there through;

wherein the inside surface of the dorsal opening of the plunger is configured to receive and be supported by a stem of an activation valve of an aerosol container against the top side wall of the upper housing;

wherein on application of a force against the plunger of the actuator, the actuator is configured to push the stem of the activation valve down to release aerosol from an aerosol can;

wherein the downward movement of the actuator under the influence of the applied force is stopped by the stop ledge of the upper housing; and wherein on relaxation of a force applied to the actuator, the actuator is configured to cause the stem of the activation valve to return to its normal position to stop release of aerosol from an aerosol can through the dorsal opening of the plunger, the channel and the ventral opening of the plunger.

2. The actuator of claim 1 wherein the ventral opening extending along the front side of the plunger includes an orifice valve.

3. The actuator of claim 1 wherein a top side of the plunger includes a downwardly tapered top surface.

4. The actuator of claim 1 wherein the stop ledge of the upper sidewall is an annular ring that substantially circumscribes the bottom side of the upper sidewall.

5. The actuator of claim 1 wherein the stop ledge of the upper sidewall is a plurality of stop ledges encircling the lower or higher sides of the upper sidewall.

6. The actuator of claim 1 wherein a diagonally extending surface extending along a bottom portion of the inner sidewall adjoins a diagonally extending surface extending along a top portion of the lower sidewall to form a smooth transition along the outer surface of the housing between the upper sidewall and the lower sidewall.

7. The actuator of claim 1 wherein the releasable holding mechanism extending an inside surface of the lower sidewall along the bore comprises a plurality of finger members, the plurality of finger members extending away from a lower portion of the inside surface of the lower sidewall into the bore of the lower sidewall in the direction of the top of the lower sidewall.

8. The actuator of claim 1 wherein the actuator is configured for use with an aerosol selected from the group consisting of paint, a detergent, a hairspray, a double phase aerosol, a single phase aerosol, a dual purpose air freshener/disinfectant, an odor remover/eliminator, a bathroom and tile cleaner, a disinfectant spray, a dusting aid, a general purpose cleaner, a general purpose degreaser, a glass cleaner spray, a metal polish/cleanser spray, an oven or grill cleaner, a sanitizer, a toilet/urinal care product, a wood cleaner, a motor vehicle wash, a rubber/vinyl protectant, an anti-static product, an anti-static product, a carpet & upholstery cleaner, a fabric protectant, a fabric refresher, a spot remover, a crawling bug insecticide, a flying bug insecticide, an insect repellant, a lawn or garden insecticide, a laundry prewash, a spot remover, an engine degreaser, an anti-seize lubricant, a cutting or tapping oil, a gear lubricant, a chain lubricant, a wire lubricant, a rubber and vinyl protectant, a rust preventative or rust control lubricant, a graffiti remover, a paint thinner, a shaving cream, a shaving gel, a footwear care product, a leather care product, and a furniture maintenance product.

9. An aerosol delivery system comprising an actuator configured for engagement with an activation valve for controlling delivery of an aerosol from an aerosol container, the system comprising:

an actuator for an activation device for controlling delivery of an aerosol from an aerosol container, the actuator comprising:

a plunger comprising a front side including a curved front surface and a protruding member, opposing sides including opposing surfaces, a back surface including a back surface, a bottom side including a bottom surface, a channel extending through the plunger from the front side of the plunger through the protruding member to the bottom side of the plunger, the channel defining a ventral opening extending along the front side of the plunger and a dorsal opening extending along the bottom side of the plunger, and a housing configured for attachment to an aerosol container, the housing comprising:

an upper sidewall extending along a top portion of the housing, a bore extending through the upper sidewall from the top to the bottom side of the upper sidewall along an inside surface of the upper sidewall, a top side wall extending along the top side of the upper sidewall from a front side of the upper sidewall to partially cover and form a partial opening of the bore along the top side of the upper sidewall, a stop ledge extending along a bottom side of the upper sidewall; a ventral opening extending along a front side of the upper sidewall, and a diagonal sliced opening formed along a back side of the upper sidewall;

a lower sidewall extending along a bottom portion of the housing, the lower sidewall defining a bore and a releasable holding mechanism, the bore extending through the lower sidewall from the top to the bottom side of the lower sidewall along an inside surface of the lower sidewall, the releasable holding mechanism extending an inside surface of the lower sidewall along the bore, the bore opening along the top side of the lower sidewall into the opening of the bore of the upper sidewall, the bore configured for receiving an aerosol container, the releasable holding mechanism configured to securely hold the housing to an aerosol container during delivery of aerosol from an aerosol container and to release an aerosol container after delivery of aerosol from an aerosol container;

an actuator for controlling delivery of an aerosol from an aerosol container; and an aerosol container;

wherein the partial opening of the bore along the top side of the upper sidewall and the sliced opening formed along the back side of the upper sidewall allows the plunger to fit through to the inside of the upper side wall;

wherein, the ventral opening of the upper sidewall allows the protruding member of the plunger to extend there through;

wherein the inside surface of the dorsal opening of the plunger is configured to receive and be supported by a stem of an activation valve of an aerosol container against the top side wall of the upper housing;

wherein on application of a force against the plunger of the actuator, the actuator is configured to push the stem of the activation valve down to release aerosol from an aerosol can;

wherein the downward movement of the actuator under the influence of the applied force is stopped by the stop ledge of the upper housing;

wherein on relaxation of a force applied to the actuator, the actuator is configured to cause the stem of the activation valve to return to its normal position to stop release of aerosol from an aerosol can through the dorsal opening of the plunger, the channel and the ventral opening of the plunger.

10. The actuator of claim 9 wherein the ventral opening extending along the front side of the plunger includes an orifice valve insert.

11. The actuator of claim 9 wherein a top side of the plunger includes a downwardly tapered top surface.

12. The upper sidewall of claim 9 wherein the stop ledge is an annular ring that substantially circumscribes the bottom side of the upper sidewall.

13. The upper sidewall of claim 9 wherein the stop ledge is a plurality of stop ledges encircling the lower or higher sides of the upper sidewall.

14. The actuator of claim 9 wherein a diagonally extending surface extending along a bottom portion of the inner sidewall adjoins a diagonally extending surface extending along a top portion of the lower sidewall to form a smooth transition along the outer surface of the housing between the upper sidewall and the lower sidewall.

15. The lower sidewall of claim 9 wherein the releasable holding mechanism extending an inside surface of the lower sidewall along the bore comprises a plurality of finger members, the plurality of finger members extending away from a lower portion of the inside surface of the lower sidewall into the bore of the lower sidewall in the direction of the top of the lower sidewall.

16. The actuator of claim 9 wherein the actuator is configured for use with an aerosol selected from the group consisting of paint, a detergent, a hairspray, a double phase aerosol, a single phase aerosol, a dual purpose air freshener/disinfectant, an odor remover/eliminator, a bathroom and tile cleaner, a disinfectant spray, a dusting aid, a general purpose cleaner, a general purpose degreaser, a glass cleaner spray, a metal polish/cleanser spray, an oven or grill cleaner, a sanitizer, a toilet/urinal care product, a wood cleaner, a motor vehicle wash, a rubber/vinyl protectant, an anti-static product, an anti-static product, a carpet & upholstery cleaner, a fabric protectant, a fabric refresher, a spot remover, a crawling bug insecticide, a flying bug insecticide, an insect repellant, a lawn or garden insecticide, a laundry prewash, a spot remover, an engine degreaser, an anti-seize lubricant, a cutting or tapping oil, a gear lubricant, a chain lubricant, a wire lubricant, a rubber and vinyl protectant, a rust preventative or rust control lubricant, a graffiti remover, a paint thinner, a shaving cream, a shaving gel, a footwear care product, a leather care product, and a furniture maintenance product.

17. A method for delivering an aerosol from an aerosol container, the method comprising:

taking an actuator configured for engagement with an activation device for controlling delivery of an aerosol from an aerosol container, the actuator comprising:

a plunger comprising a front side including a curved front surface, opposing sides including opposing surfaces, a back surface including a back surface, a bottom side including a bottom surface, a channel extending through the plunger from the front side of the plunger to the bottom side of the plunger, the channel defining a ventral opening extending along a front side of the plunger and a dorsal opening extending along the bottom side of the plunger; and a housing configured for attachment to an aerosol container, the housing comprising:

an upper sidewall extending along a top portion of the housing, a bore extending through the upper sidewall from the top to the bottom side of the upper sidewall along an inside surface of the upper sidewall, a top side wall extending along the top side of the upper sidewall from a front side of the upper sidewall to partially cover and form a partial opening of the bore along the top side of the upper sidewall, a stop ledge extending along a bottom side of the upper sidewall; a ventral opening extending along a front side of the upper sidewall, and a diagonal sliced opening formed along a back side of the upper sidewall;

a lower sidewall extending along a bottom portion of the housing, the lower sidewall defining a bore and a releasable holding mechanism, the bore extending through the lower sidewall from the top to the bottom side of the lower sidewall along an inside surface of the lower sidewall, the releasable holding mechanism extending an inside surface of the lower sidewall along the bore, the bore opening along the top side of the lower sidewall into the opening of the bore of the upper sidewall, the bore configured for receiving an aerosol container, the releasable holding mechanism configured to securely hold the housing to an aerosol container during delivery of aerosol from an aerosol container and to release an aerosol container after delivery of aerosol from an aerosol container;

placing the plunger through the partial opening of the bore along the top side of the upper sidewall and the sliced opening formed along a back side of the upper sidewall allows the plunger to fit through to the inside of the upper sidewall to the inside of the upper sidewall; placing the inside surface of the dorsal opening of the plunger to receive and be supported by a stem of an activation valve of an aerosol container against the top side wall of the upper housing; placing the protruding member of the plunger through the ventral opening of the upper sidewall;

applying force to cause the downward movement of the actuator.

18. The method of claim 17 further comprising the step of stopping the downward movement of the actuator by the stop ledge of the upper housing.

19. The method of claim 17 further comprising the step of relaxing the force applied to the actuator, to cause the stem of the activation valve to return to its normal position to stop release of aerosol from an aerosol can.

* * * * *